US007866097B1

(12) United States Patent
Moyher

(10) Patent No.: US 7,866,097 B1
(45) Date of Patent: Jan. 11, 2011

(54) RADON VENTING CONCRETE FORMS

(76) Inventor: Charles S Moyher, 9 Dusty La., Newtown, CT (US) 06470

( * ) Notice: Subject to any disclaimer, the term of this patent is extended or adjusted under 35 U.S.C. 154(b) by 1253 days.

(21) Appl. No.: 11/446,745

(22) Filed: Jun. 5, 2006

Related U.S. Application Data

(63) Continuation-in-part of application No. 10/672,637, filed on Sep. 27, 2003, now abandoned.

(51) Int. Cl.
*E02D 31/00* (2006.01)

(52) U.S. Cl. ..... 52/169.5; 52/302.4; 52/900; 454/909

(58) Field of Classification Search ..... 249/34, 249/4, 5, 6, 7; 52/169.5, 900, 302.1, 302.3, 52/302.4; 454/909
See application file for complete search history.

(56) References Cited

U.S. PATENT DOCUMENTS

| | | | | |
|---|---|---|---|---|
| 756,300 | A | 4/1904 | Underwood | |
| 835,669 | A | 11/1906 | Eckley | |
| 836,017 | A | 11/1906 | Douglas | |
| 1,891,934 | A | 12/1932 | Joy | |
| 3,391,507 | A | 7/1968 | Downing | |
| 3,613,323 | A | 10/1971 | Hreha | |
| 3,722,849 | A | 3/1973 | Luyben | |
| 4,124,963 | A | 11/1978 | Higuchi | |
| 4,186,160 | A | 1/1980 | Landreth | |
| 4,333,281 | A | 6/1982 | Scarfone | |
| 4,381,630 | A | 5/1983 | Koester | |
| 4,528,787 | A * | 7/1985 | Rittinge | 52/169.5 |
| 4,903,450 | A | 2/1990 | Adams | |
| 5,120,162 | A | 6/1992 | Parker | |
| 5,174,083 | A | 12/1992 | Mussell | |
| 5,224,799 | A | 7/1993 | Parker | |
| 5,390,050 | A | 2/1995 | Yanagi et al. | |
| 5,399,050 | A | 3/1995 | Jacobus | |
| 5,406,758 | A | 4/1995 | Baum | |
| 5,444,950 | A * | 8/1995 | Kelly et al. | 52/169.5 |
| 5,474,400 | A | 12/1995 | Kliefoth et al. | |
| 5,475,950 | A | 12/1995 | Palmer | |
| 5,535,556 | A | 7/1996 | Hughes, Jr. | |
| 5,586,416 | A | 12/1996 | Hess, III et al. | |
| 5,694,723 | A | 12/1997 | Parker | |
| 5,740,638 | A | 4/1998 | Shepherd, III | |
| 5,771,643 | A | 6/1998 | Parker | |

(Continued)

*Primary Examiner*—Michael Safavi
(74) *Attorney, Agent, or Firm*—Michael Kroll

(57) ABSTRACT

The present invention 10 discloses a concrete form system for building foundations wherein two substantially parallel form walls 12 are constructed using a plurality of retainer sections that can mechanically interlock end-to-end 42, 44 when the retainer sections 14, 16, 18, 20 incorporate a throughbore 22 or butt-up end to end when there is no throughbore. Additionally the present invention provides a separator bar and reinforcement posts whereby the separator bar 24 serves as base for the retainer sections and as spacer between stacked retainer sections 14, 16, 18, 20 which can in cross-section have a circular, oval or polygonal shape and in one additional element a ribbed exterior portion 46, 48 for added strength and a substantially hollow interior 22 that forms a corrugated conduit retainer 20 that is conducive to providing ventilation for effective and efficient radon remediation from the structure being constructed. The aforementioned corrugated retainer 20 uses a combination of straps 50 and spreaders 40 to maintain the two form retainer wall 12 in place prior to and during the pouring of the concrete 36.

6 Claims, 18 Drawing Sheets

U.S. PATENT DOCUMENTS 5,836,716 A 11/1998 Johnson
5,884,439 A * 3/1999 Hess et al. ..... 52/155
5,953,864 A 9/1999 Beck
6,123,745 A 9/2000 Hess, III
6,321,498 B1 11/2001 Trovato
6,619,001 B1 * 9/2003 Pratt ..... 52/169.5
6,634,144 B1 * 10/2003 Moore et al. ..... 52/169.5
6,669,404 B2 12/2003 Le Blanc
6,742,758 B2 * 6/2004 Janesky ..... 249/7
2003/0200707 A1 10/2003 Parker

* cited by examiner

RADON VENTING CONCRETE FORMS

RELATED APPLICATIONS

This application is a continuation-in-part of U.S. patent application filed Sep. 27, 2003 and assigned Ser. No. 10/672,637 now abandoned.

BACKGROUND OF THE INVENTION

1. Field of the Invention

The present invention relates generally to concrete forms and, more specifically, to a concrete form system for building foundations wherein two substantially parallel walls are constructed using a plurality of wall sections that mechanically interlock end-to-end with separators holding the wall sections in spaced relation while concrete is poured between the parallel walls.

The present invention provides that the separators can be removed after the pouring or used as rebar support, in which case the separators remain as part of the foundation footer.

The present invention uses a combination of straps and spreaders to maintain the two wall sections in place prior to and during the pouring of the concrete.

2. Description of the Prior Art

There are other concrete form systems for use in constructing building foundations. Typical of these is U.S. Pat. No. 756,300 issued to Underwood on Apr. 5, 1904.

Another patent was issued to Eckley on Nov. 13, 1906 as U.S. Pat. No. 835,669. Yet another U.S. Pat. No. 836,017 was issued to Douglass on Nov. 13, 1906 and still yet another was issued on Dec. 27, 1932 to Joy, et al. as U.S. Pat. No. 1,891,934.

Another patent was issued to Downing on Jul. 9, 1968 as U.S. Pat. No. 3,391,507. Yet another U.S. Pat. No. 3,613,323 was issued to Hreha on Oct. 19, 1971. Another was issued to Luyben on Mar. 27, 1973 as U.S. Pat. No. 3,722,849 and still yet another was issued on Nov. 14, 1978 to Higuchi as U.S. Pat. No. 4,124,963.

Another patent was issued to Landreth on Jan. 29, 1980 as U.S. Pat. No. 4,186,160. Yet another U.S. Pat. No. 4,333,281 was issued to Scarfone on Jun. 8, 1982. Another was issued to Koester on May 3, 1983 as U.S. Pat. No. 4,381,630 and still yet another was issued on May 3, 1983 to J. H. Koester as U.S. Pat. No. 4,381,630.

Another patent was issued to Adams on Feb. 27, 1990 as U.S. Pat. No. 4,903,450. Yet another U.S. Pat. No. 5,120,162 was issued to Parker on Jun. 9, 1992. Another was issued to Mussell on Dec. 29, 1992 as U.S. Pat. No. 5,174,083 and still yet another was issued on Jul. 6, 1993 to Parker as U.S. Pat. No. 5,224,799.

Another patent was issued to Jacobus on Mar. 21, 1995 as U.S. Pat. No. 5,399,050. Yet another U.S. Pat. No. 5,406,758 was issued to Baum on Apr. 18, 1995. Another was issued to Kliefoth, et al. on Dec. 12, 1995 as U.S. Pat. No. 5,474,400 and still yet another was issued on Dec. 19, 1995 to Palmer as U.S. Pat. No. 5,475,950.

Another patent was issued to Hughes, Jr. on Jul. 16, 1996 as U.S. Pat. No. 5,535,556. Yet another U.S. Pat. No. 5,586,416 was issued to Hess, III on Dec. 24, 1996. Another was issued to Parker on Dec. 9, 1997 as U.S. Pat. No. 5,694,723 and still yet another was issued on Apr. 21, 1998 to Shepard, III as U.S. Pat. No. 5,740,638.

Another patent was issued to Parker on Jun. 30, 1998 as U.S. Pat. No. 5,771,643. Yet another U.S. Pat. No. 5,836,716 was issued to Johnson, et al. on Nov. 17, 1998. Another was issued to Beck on Sep. 21, 1999 as U.S. Pat. No. 5,953,864 and still yet another was issued on Sep. 26, 2000 to Hess, III et al. as U.S. Pat. No. 6,123,745.

Another patent was issued to Trovato on Nov. 27, 2001 as U.S. Pat. No. 6,321,498. Yet another U.S. Patent Application No. 2003/0200707 was published on Oct. 30, 2003 and another U.S. Pat. No. 6,669,404 issued to LeBlanc on Dec. 30, 2003.

U.S. Pat. No. 756,300

Inventor: Robert L. Underwood

Issued: Apr. 5, 1904

A building-block provided with a longitudinal passage entirely encompassed by the material thereof, and a vertical passage communicating therewith and extending for a portion only of the height of said block, and a lateral passage.

U.S. Pat. No. 835,669

Inventor: Matthew Eckley

Issued: Nov. 13, 1906

A building-block comprising a substantially rectangular body portion having a flat unobstructed base and provided at its upper face with a longitudinal groove spaced from one end of the block and opening through the opposite end thereof, said groove having its side walls inclined toward the opposite exposed faces of the block and its end wall inclined toward the adjacent end of the block, there being a plurality of vertical air-flues intersecting the longitudinal groove and an opening formed in one end of the block and communicating with one of said flues, and a tube seated in the opening and provided with a screen, there being a vertical recess formed in the opposite end of the block and mortar-receiving grooves, disposed one on each side of the vertical recess.

U.S. Pat. No. 836,017

Inventor: James A. Douglas

Issued: Nov. 13, 1906

A building-block having a. plurality of parallel longitudinal passages extending from top to bottom of the block a groove in the end face of the block, and channels connecting the said groove directly with the said first-named passages.

U.S. Pat. No. 1,891,934

Inventor: Wilford P. Joy

Issued: Dec. 27, 1932

A building foundation comprising a plurality of foundation units including a pair of units arranged at an angle with respect to each other to provide a corner of the foundation, each of said units being provided with a passageway extended longitudinally therethrough which serves to produce a part of a drainage channel, and one of said angularly arranged units being provided with a passageway formed transversely through the wall thereof to provide means of communication between the longitudinal passageway therein and the longitudinal passageway in the associated angular unit, and a cover for the passageway formed through one of said angular units.

Said cover being provided with perforations providing definitely located passageways leading from the outer face of the foundation to said drainage channel.

U.S. Pat. No. 3,391,507

Inventor: Doris D. Downing

Issued: Jul. 9, 1968

A building block comprising: a substantially rectangular body having a pair of parallel end faces, a top face, a bottom face, an outer face and inner face; at least one conduit extending through said body substantially perpendicular to said end faces; said conduit being tapered down from each end to a minimum diameter between the end faces, said conduit further having enlarged constant diameter portions adjacent each end face; and a plurality of bores extending perpendicularly through said top face, one-half of said bores extending completely through the body of said block and through said bottom face to form long bores and one-half of said bores extending only part way down to said bottom face to form short bores.

U.S. Pat. No. 3,613,323

Inventor: Fred J. Hreha

Issued: Oct. 19, 1971

This specification discloses a form intended for use in the casting of concrete or cement foundations and which has a drain tile integral with an element thereof. The form comprises two flat walls sections detachable connected. A drain tile is integrally formed on the lower wall section and is of a rectangular cross section presenting spaced horizontal walls and a side wall. The latter is formed with a plurality of spaced drainage openings and the horizontal walls are formed at spaced intervals with aligned slot-like apertures adjacent to the wall section from which they extend. Stakes are driven through these apertures and nailed to the upper wall section of the form. A mechanical interlock between the lower wall section and the material cast is provided and may take different forms.)

U.S. Pat. No. 3,722,849

Inventor: William John Luyben

Issued: Mar. 27, 1973

A metal bar has upturned end flanges on opposite ends of a base portion arranged to provide stops against the outward movement of a pair of vertical form panels resting on the clip. Spaced inwardly from said end flanges is a pair of outwardly directed tongues struck out from said base portion in inclined positions with elevated ends spaced from said flanges. The form panels are received in the spaces between the end flanges and the tongues. Panels improperly placed in the mid portion of the clip may be readily pushed out against the end flanges or the pouring of the concrete will push the panels out to their proper positions. The tongues provide sloping ramp surfaces to facilitate the outward movement of the panels. The clip is also utilized in making forms for the monolithic pouring of a wall and footing. In one embodiment the clip is mounted on stakes in the footing pour area to support the wall form panels. In another embodiment in similar arrangement the clips are made long enough for mounting on the top edges of the footing form panels.

U.S. Pat. No. 4,124,963

Inventor: Tadayasu Higuchi

Issued: Nov. 14, 1978

A process for forming a continuous footing for building a house comprising digging trenches in accordance with the layout of a house to be built, forming a rubble and gravel bed in the trenches, placing a plurality of leveling pieces on the bed and leveling only the leveling pieces by laying sand thereunder, placing footing blocks on the leveling pieces so as to bridge them, pouring gravel in the trenches, compacting the gravel and rubble so that they are tightly compacted under the footing blocks up to the bottom of the footing blocks, thereafter removing the leveling pieces, and finally placing gravel in the spaces which have been occupied by the leveling pieces and compacting the gravel under the joints of the blocks, is disclosed.

U.S. Pat. No. 4,186,160

Inventor: George H. Landreth

Issued: Jan. 29, 1980

A method for forming three parallel elongate grooves of predetermined size and spacing in a hardenable building material during a plastic state thereof, for forming a perimeter-type building foundation.

U.S. Pat. No. 4,333,281

Inventor: Santo Scarfone

Issued: Jun. 8, 1982

A basement wall drain unit for removing moisture from a basement wall formed of concrete blocks resting on a footing adjacent a concrete basement floor, wherein the concrete floor is poured against the drain unit so that a space is formed between the drain unit and an inner surface of the wall and between the drain unit and the footing into which moisture may drain from the interior of the wall through drain passages in the wall and then down beneath the basement floor to a weeping drain.

U.S. Pat. No. 4,381,630

Inventor: John H. Koester

Issued: May 3, 1983

A foundation vent structure is positioned upon the footing of a building below the lowermost row of concrete blocks of the basement wall and extends below the concrete floor of the basement. The vent structure is formed of a plastic material, preferably in strips, and is shaped to define alternate tunnels and channels having openings therein. The vent structure intercommunicates the openings in the hollow, concrete blocks with the drain area located along the marginal area below the basement wall to permit moisture to be vented into this drain area.

U.S. Pat. No. 4,903,450

Inventor: Fred H. Adams

Issued: Feb. 27, 1990

A concrete footer block and foundation system formed therefrom for a concrete block wall is provided and comprises a plurality of elongate concrete masonry footer blocks positioned in side-to-side abutting relationship along an axis parallel to the concrete wall to be supported by the foundation system. The footer blocks include an enlarged triangular cavity therein which extends across the footer block and downwardly into at least the middle portion of the block. The cavity is open on each side of the block as well as at the top surface thereof and has a bottom surface which is parallel to the bottom surface of the footer block and includes a plurality of spaced-apart first support ribs extending across the block and at least one second support rib extending perpendicularly to the first support ribs and parallel to the lengthwise direction of the footer block for supporting, respectively, reinforcement wire and reinforcement rods thereon in spaced-apart relation from the bottom surface of the cavity.

U.S. Pat. No. 5,120,162

Inventor: Alton F. Parker

Issued: Jun. 9, 1992

A concrete footing/foundation retainment co-features integral (unitary) drainage means. Two preferred embodiments present, first, a rigid, environmentally nondegradable and free-standable footing/foundation concrete retainment form similar to an ordinary plank but featuring a hollow core which communicates through a multiplicity of foramens (holes) with only one face of the plank, the other being smooth and generally unrelieved in character. The second preferred embodiment presents a similar plank bearing a collinear, foraminous conduit adjacent one margin of the plank and permanently joined with the plank member. Thus, in the second embodiment, only one face is essentially smooth and unrelieved, while the other, in cross-section, appears bulbous. The bulbous feature may take on any conceivable geometric definition ranging from a semi-tubular to a rectangular conduit shape. The invention is composed of a material that lends itself, not only to environmental nondegradability, but also to ready cutting, melting or abrading. This feature allows the forms, when set as a footing/foundation retainment, to be miter-cut and, thereafter staked in place with, or without, subsequent gluing or welding by known adhesive or heating means.

U.S. Pat. No. 5,399,050

Inventor: James L. Jacobus

Issued: Mar. 21, 1995

A thermoplastic sidewall forms one surface of a concrete form. The sidewall incorporates a drainage tile as an integral unit. Two of the sidewalls combined can provide a form for a concrete footer to be poured and remain as a permanent part of the structure.

U.S. Pat. No. 5,174,083

Inventor: Barry D. Mussell

Issued: Dec. 29, 1992

A concrete forming system for the casting of floating slab building foundations with perimeter insulation. Form panels (14A), (14B), (14C), and (14D) comprised of foam core (54) and metal rails (42) and (44), and overlain with stress skins (50), are connected by form tie assemblies (18A), (18B), (18C), and (18D). A protective shield (40) covers the exposed portions of panels (14A) and (14D). Metal stakes (16) anchor formwork assemblies to the earth. System includes embedded anchors (64) and (38). Panel connectors (30) and (32) allow formwork assemblies to be pre-assembled into long lengths, which provides straight and level slab edges and great labor savings. Forming system provides lightweight forming panels, stakes, and lateral bracing which remain in place, providing perimeter insulation and finish exterior surfaces.

U.S. Pat. No. 5,224,799

Inventor: Alton F. Parker

Issued: Jul. 6, 1993

A permanently-installed form-drain (10) including hollow, foraminous planks (12) and connectors (16,18) for joining two or more of the planks in a continuously arranged concrete barrier. The instant improvements include an adapter (20/21), which serves as a straight connector, grooved plank (19) with interlocking stake (13/14), integral connector-stake and adapter-stake device (16/14, 20/14) and a tri-functional, generally rigid bracket and bracket-stake (22 and 22/22x) element, used to space and restrain/constrain the planks and/or to hold (support) reinforcement bars.

U.S. Pat. No. 5,399,050

Inventor: James L. Jacobus

Issued: Mar. 21, 1995

A thermoplastic sidewall forms one surface of a concrete form. The sidewall incorporates a drainage tile as an integral unit. Two of the sidewalls combined can provide a form for a concrete footer to be poured and remain as a permanent part of the structure.

U.S. Pat. No. 5,406,758

Inventor: Melvin R. Baum

Issued: Apr. 18, 1995

A combined drain tile and form for a foundation perimeter drainage system includes a hollow tubular drain tile, having a longitudinal opening along one side, connected along the longitudinal opening to a planar form portion. The tubular portion has a plurality of drainage holes. The form portion acts as a wall for a concrete or cement form, thereby eliminating the step of removing the form prior to laying drain tile in a perimeter drainage system.

U.S. Pat. No. 5,474,400

Inventor: Christopher J. Kileforth

Issued: Dec. 12, 1995

A permanent form-drain network adapted for radon remediation. A permanently installed form-drain system is partially piecewise modified and adapted to collect and remove radon gas from sub-slab, as well as basement and similar near-subterranean, portions of building. The partial piecewise modification of an existing form-drain includes adapting existing connector elements of the form-drain with vent tubes and differently molded pieces such as offset transition conduits and "T" shaped divergent conduits. The method for installing the invention conceives of the use of a radon accretion zone gas barrier made of an impermeable membrane.

U.S. Pat. No. 5,475,950

Inventor: Thomas M. Palmer

Issued: Dec. 19, 1995

A lightweight permanent concrete footing form section includes a base sheet that is horizontal with substantially planar upper and lower surfaces. Side walls integral with the base append upward from the base in a generally vertical and planar direction. Ducts are attached to the side walls for carrying water away from the concrete footing after the concrete has been poured and set. Sections may be interconnected and dimensioned according to plans.

U.S. Pat. No. 5,535,556

Inventor: John P. Hughes, Jr.

Issued: Jul. 16, 1996

A basement wall is formed by a series of vertical metal studs supported at their lower ends on a metal sill extending along the upper face of a concrete footing. An insulating sheathing is mounted on the metal studs to form the wall outer surface. The sheathing is formed by two panel layers of rigid foam core insulator material. Edges of the inner panels are offset from the edges of the outer panels to form labyrinth seals preventing migration of ground water through the sheathing.

U.S. Pat. No. 5,586,416

Inventor: John Hess, III et al.

Issued: Dec. 24, 1996

A footing/foundation form with an integral drain having two substantially parallel spaced apart, serpentuitous walls. Each wall includes a plurality of hollow tubes elevated "to grade" above an excavation bottom by a stake and clip mechanism with gravel filled between the elevated tubes and the excavation bottom such that the elevated tube and gravel both engage concrete poured between the walls. The tubes are common 10-foot PVC tubes with a plurality of holes positioned away from the footing/foundation thereby providing the form with an integral drain. The stakes are preferably pieces of reinforcing bar and the clips, while quite effective, are also inexpensively manufactured.

U.S. Pat. No. 5,694,723

Inventor: Alton F. Parker

Issued: Dec. 9, 1997

A concrete slab and wall spacer with water and radon removal elements. The invention includes a cross-sectionally, L-shaped elongate strip of semi-rigid, non-biodegradable material. At least halfway up the entire elongate vertical leg of the L-shape may be a horizontally disposed projection which is integral with the strip. The spacer projection is placed against a wall, the L base resting on a portion of the footing subtended by the wall in a conventional spacer usage. A spacer may be provided for additional support of the L-shaped strip. This spacer is easily removable after the floating slab has set, or the spacer may be left in place for use as a decorative molding. Several applications for the strip, are disclosed, one being the sealing of the shelf to the abutting wall with placement of a gas impermeable membrane in an overlapping arrangement with the L base so as to form, relative to the strip and the abutted wall, an upper fluid region and a lower gas region. The gas region is vented by a conduit which penetrates the projection, while the water in the upper liquid region is removed by other conventional methods, conceivably by through-the-wall conduits or a sump region built into or adjacent the footing.

U.S. Pat. No. 5,740,638

Inventor: Allen S. Sheppard

Issued: Apr. 21, 1998

A combination drainage system and radon gas venting system for a structure foundation as disclosed which utilizes solid rubber particle fill as a free draining and venting medium.

U.S. Pat. No. 5,771,643

Inventor: Alton F. Parker

Issued: Apr. 21, 1998

A concrete slab and wall spacer with water and radon removal elements. The invention includes a cross-sectionally, L-shaped elongate strip of semi-rigid, nonbiodegradable material. At least halfway up the entire elongate vertical leg of the L-shape is a horizontally disposed projection which is integral with the strip. The spacer projection is placed against a wall, the L base resting on a portion of the footing subtended by the wall in a conventional spacer usage. The underside of the base of the L is generally relieved in order to allow transmigration of water and gaseous substances. Several applications for the strip are disclosed, one being the sealing of the shelf to the abutting wall with placement of a gas impermeable membrane in an overlapping arrangement with the L base so as to form, relative to the strip and the abutted wall, an upper fluid region and a lower gas region. The gas region is vented by a conduit which penetrates the projection, while the water in the upper liquid region is removed by other conventional methods, conceivably by through-the-wall conduits or a sump region built into or adjacent the footing.

U.S. Pat. No. 5,836,716

Inventor: Wm. Ralph Johnson

Issued: Nov. 17, 1998

A subsurface drainage pipe includes a tubular main pipe body having inner and outer surfaces and a longitudinal central axis. Walls defining a plurality of slot-shaped apertures through the inner and outer surfaces along the length of the main pipe body are provided. The slot shaped apertures are angled with respect to the central axis.

U.S. Pat. No. 5,953,864

Inventor: William G. Beck

Issued: Sep. 21, 1999

A subterranean building structure has a footing surface and end to end matching concrete wall shell segments arranged in longitudinally abutting relation on the footings. One of the wall sections has an embedded, horizontally extending lock part, and the other has an embedded camming assembly receiving the locked part and creating relative movement of the wall segments into sealed, wedged abutting relation with the operation of manipulatable camming assembly which are accessible through the interior walls of the studded concrete wall sections. Within the concrete shell sections, wire mesh reinforcement extends substantially throughout the wall panels and rebar reinforcement is fixed to this reinforcement as well as to each lock part and camming assembly so that a continuous integrated skeleton framework extends through all walls of the basement enclosure and ties all walls together in one integrated steel skeleton or framework. The factory fabricated concrete panels have factory installed insulation, provision for introducing wiring conduit, and wall board as well.

U.S. Pat. No. 6,123,745

Inventor: John Hess, III

Issued: Sep. 26, 2000

An adjustable concrete form comprises at least one tube and an adjustable stake having a post and a tube cradle. A bracket is removably connected to the tube for supporting rebar in spaced-apart relation to the excavation bottom. The bracket includes a tube engaging portion and a rebar supporting portion. The tube engaging portion is configured for connecting the bracket to the tube. The rebar supporting portion extends laterally from a proximal end connected to the tube engaging portion to a distal end spaced from the tube engaging portion.

U.S. Pat. No. 6,321,498

Inventor: Salvatore Trovato

Issued: Nov. 27, 2001

A formwork for building bearing walls comprises a plurality of pairs of facing panels (PE, PI) connected together so as to form an inside space between them, said pairs of facing panels being arranged in superimposed rows, the panels of each pair being connected to each others by braces (6) of adjustable length with both the braces (6) and the panels (PE, PI) being left in the wall formed when a cementitious material poured in said inside space has solidified. The so formed walls are provided with bearing partition members and ventilating duct, and are strongly insulated and already finished (FIG. 6).

U.S. Patent Application Number 2003/0200707

Inventor: Alton F. Parker

Issued: Oct. 30, 2004

A form for use with hardenable, flowable material such as concrete, wherein the form is flexible along a first axis and rigid along a second axis. The form may further include perforations in one side of the form such that when the form is left in place the form acts as a drain.

U.S. Pat. No. 6,669,404

Inventor: Donald F. LeBlanc

Issued: Dec. 30, 2003

A low cost, low skill method, and system produced by the method, of providing fluid drainage for a cast concrete footing, including placing a drainage mat against and along the inside of the outside-form-wall; attaching one end of a through-conduit in fluid communication with the drainage mat and extending the other end flush with the inside of the inside-form-wall; placing concrete between the forms; allowing concrete reasonably to cure; removing the forms; attaching conventional drainage to the exposed end of the through-conduit; and backfilling the foundation.

While these concrete forms may be suitable for the purposes for which they were designed, they would not be as suitable for the purposes of the present invention, as hereinafter described.

SUMMARY OF THE PRESENT INVENTION

The present invention discloses a concrete form system for building foundations wherein two substantially parallel form walls are constructed using a plurality of wall sections that can mechanically interlock end-to-end and optionally have a throughbore that forms a passage and is conducive to providing ventilation for effective and efficient radon or other unwanted gas remediation from the structure being constructed. In one additional element, the present invention uses a combination of straps and spreaders to maintain the two conduit sections in place prior to and during the pouring of the concrete.

A primary object of the present invention is to provide a concrete form with radon venting capabilities.

Another object of the present invention is to provide a concrete form with radon venting capabilities that is substantially rectangular in shape with a hollow interior and two opposing open ends that form a conduit.

Yet another object of the present invention is to provide a concrete form with radon venting capabilities wherein the form is assembled by mechanically interlocking the individual form sections into one another in end-to-end fashion to form a wall and constructing a similar form parallel to the first wall and using a combination of straps and spreaders to maintain the two wall sections in place prior to and during the pouring of concrete therebetween.

Still another object of the present invention is to provide a concrete form with radon venting capabilities wherein the exterior surface of the conduit section is ribbed to increase the strength thereof.

Another object of the present invention is to provide a concrete form with radon venting capabilities that is lightweight and portable.

Still yet another object of the present invention is to provide a concrete form with radon venting capabilities wherein the conduit wall sections have a hollow interior with a greater area to provide an efficient means for increased radon remediation.

Yet another object of the present invention is to provide a concrete form with radon venting capabilities that is inexpensive to manufacture and operate.

One more object of the present invention is to provide a concrete form with radon venting capabilities that is simple and easy to use.

Additional objects of the present invention will appear as the description proceeds.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
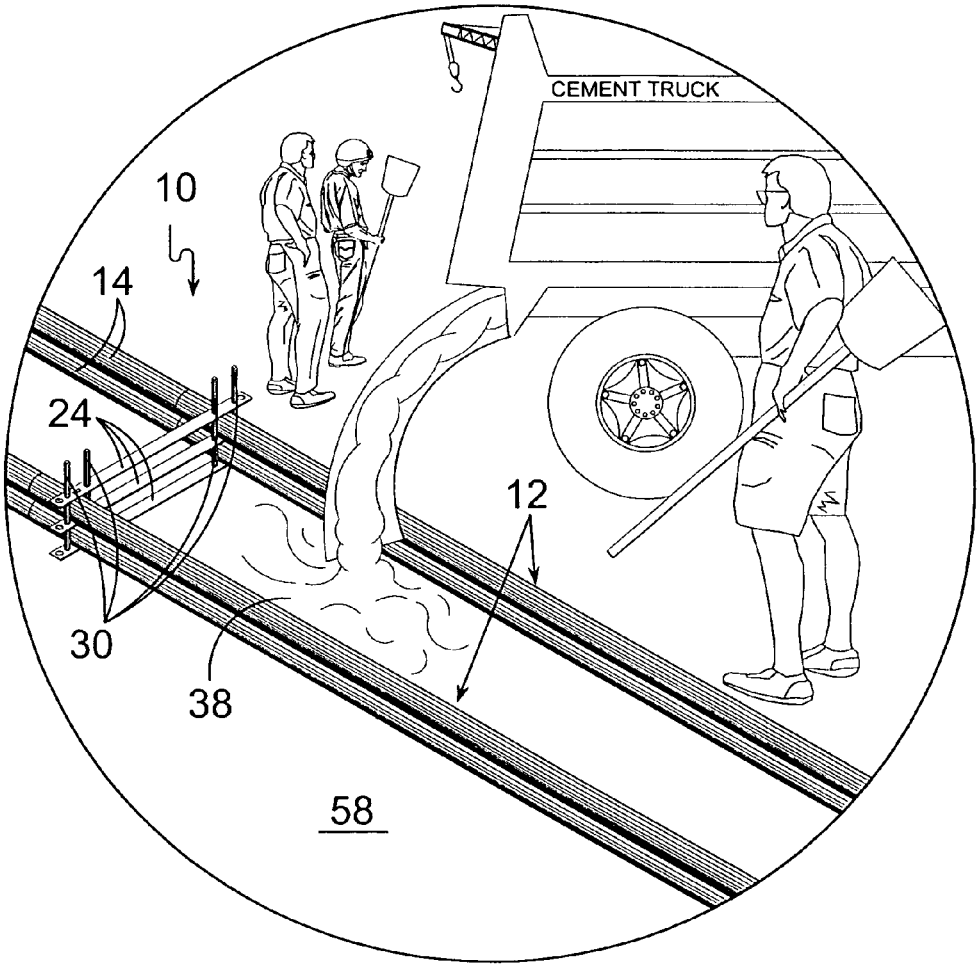
FIG. 1 is a perspective view of the present invention.

With regard to reference numerals used, the following numbering is used throughout the drawings.

10 present invention
12 form retainer wall
14 tubular retainer
16 slab retainers
18 conduit retainers
20 corrugated conduit retainer
22 throughbore
24 separator bar
25 separator bar lip
26 aperture
28 reinforcement post aperture
30 reinforcement post
32 serrations
34 apertures of 30
36 base plate of 30
38 concrete
40 spreader
42 male end
44 female end
46 corrugation
48 corrugation
50 strap
52 foundation
54 footing
56 walls
58 soil
60 concrete footer
62 concrete
64 slab
66 rebar
68 vent
70 cross-vent

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown is the foundation footing form of the present invention. The present invention provides form retaining walls 12 that use various materials and shapes for the form retainer walls 12, such as tubular retainers 14, as illustrated. The form retainer walls 12 can be comprised of single or stacked retaining section positioned on or in soil 58. In either case, one or more separator bars 24 and reinforcement posts 30 are used to keep the form walls 12 spaced apart while the footing concrete 38 is being poured.

Figure 2:
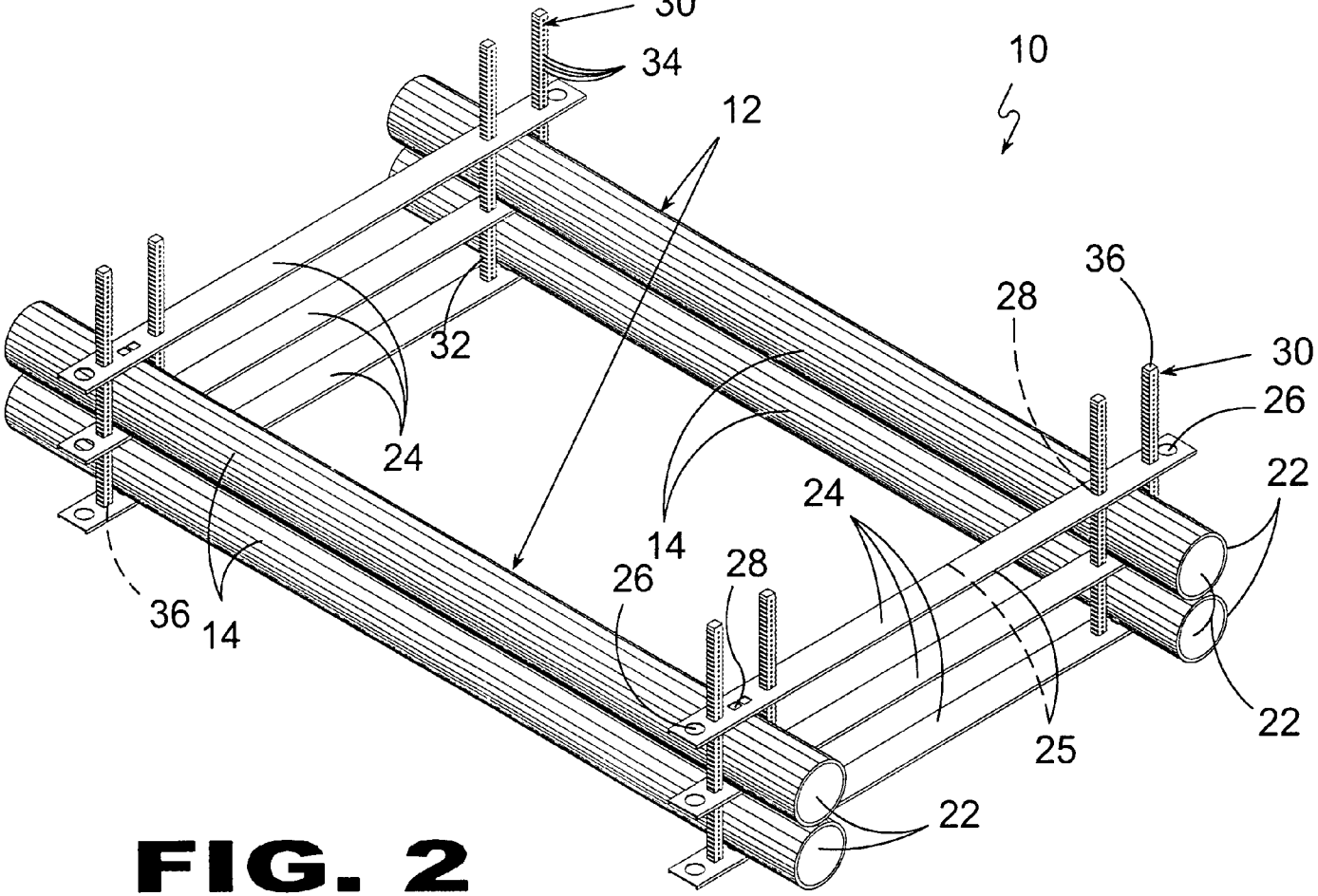
FIG. 2 is a perspective view of the components of the present invention.

Turning to FIG. 2, shown is the foundation footing form of the present invention. The present invention provides form retaining walls 12 that use various materials and shapes for the form retainer walls 12, such as tubular retainers 14, as illustrated. The form retainer walls 12 can be comprised of single or stacked retaining section. In either case, one or more separator bars 24 and reinforcement posts 30 are used to keep the form walls 12 spaced apart while the footing concrete is being poured. The separator bar 24 has lip 25 extending the length of both sides with a plurality of apertures 26, 28 for receiving a stake or reinforcement post 30, having opposing sides with serration 32 extending therefrom and apertures 34 passing between the adjacent sides. Preferably, aperture 28 and post serrations 32 are sized to frictionally engage one another whereby placement of a separator bar 24 aperture 28 relative to desired serrations or teeth 32 prevents casual displacement. Additionally post apertures 34 provide means whereby a length of line can be inserted therethrough and additional articles tethered to the post.

Figure 3:
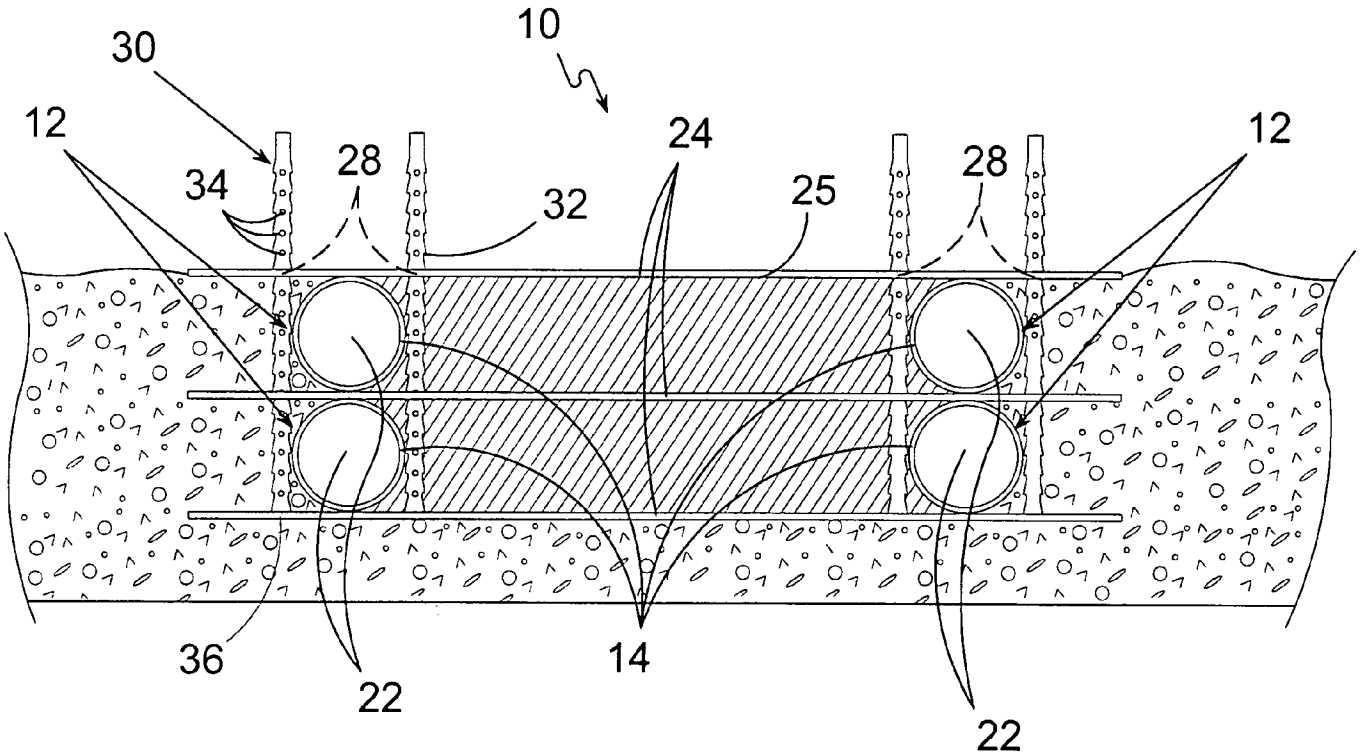
FIG. 3 is a cross sectional side of the conduit of the present invention.

Turning to FIG. 3, shown is a sectional view of the foundation footing form of the present invention. The present invention provides form retaining walls 12 that use various materials and shapes for the form retainer walls 12, such as tubular retainers 14, as illustrated. The form retainer walls 12 can be comprised of single or stacked retaining section. Depicted is a plurality of separator bars 24 and reinforcement posts 30 used to fix the form walls 12 spacing while the footing concrete is being poured. The separator bar 24 has lip 25 extending the length of both sides with a plurality of apertures 26, 28 for receiving a stake or reinforcement post 30. Apertures 28 are spaced so that retaining walls 12 are held between a pair of posts 30 with each post 30 having opposing sides with serrations or teeth 32 extending therefrom and apertures 34 passing between the adjacent sides. Preferably, aperture 28 and post serrations 32 are sized to frictionally engage one another whereby placement of a separator bar 24 aperture 28 relative to desired serrations or teeth 32 prevents casual displacement. Additionally post 30 apertures 34 provide means whereby a length of line can be inserted therethrough and additional articles tethered to the post.

Figure 4:
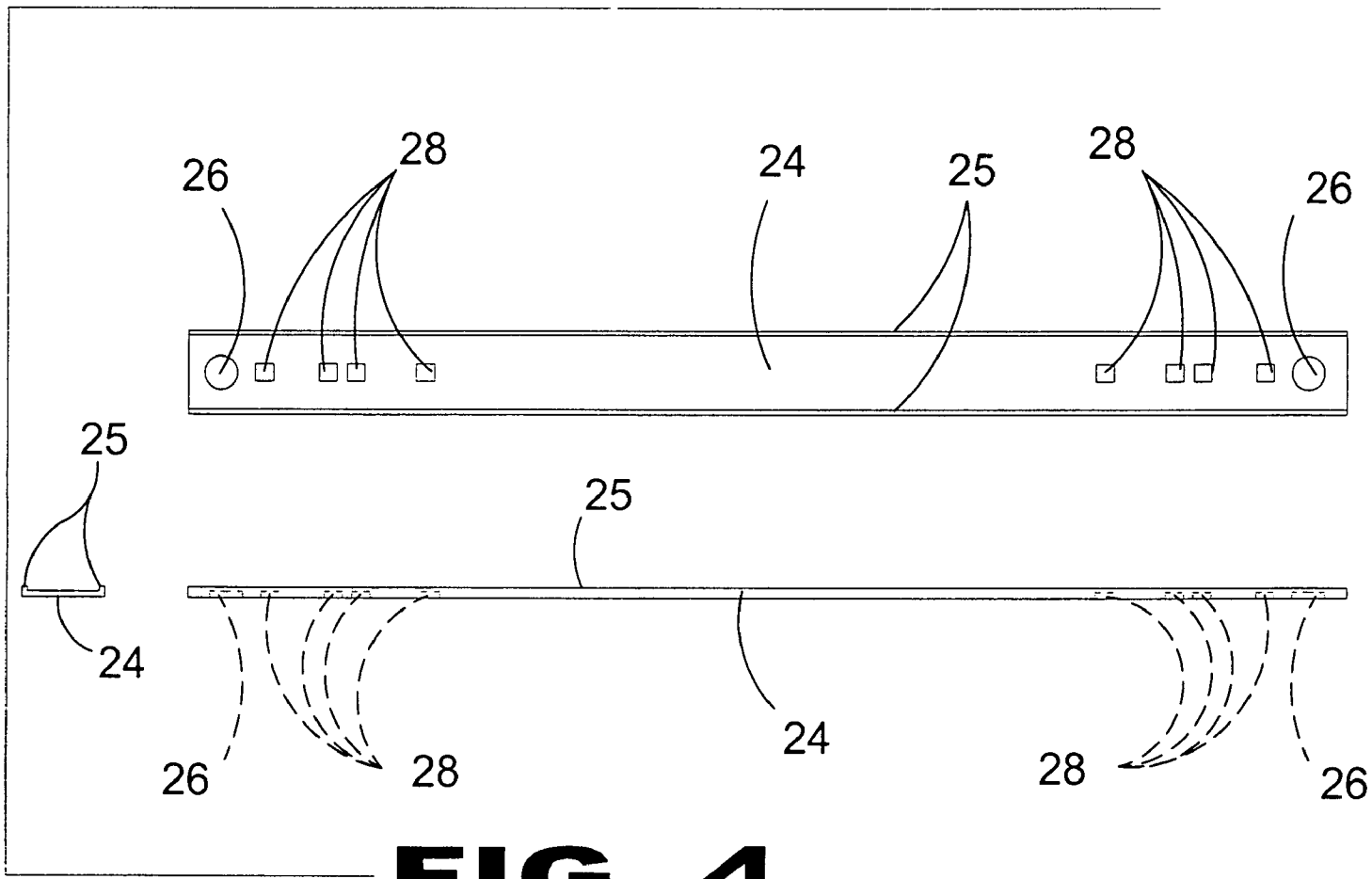
FIG. 4 is a top view of a structural foundation formed by the present invention.

Turning to FIG. 4, shown are views of the separator bar. The separator bar 24 has lip 25 extending the length of both sides with a plurality of apertures 26, 28 for receiving a stake or reinforcement post 30. Apertures 28 are spaced so that retaining walls 12 are held between a pair of posts 30 with each post 30 having opposing sides with serrations or teeth 32 extending therefrom and apertures 34 passing between the adjacent sides. Aperture 26 is sized to receive a stake such as rebar.

Figure 5:
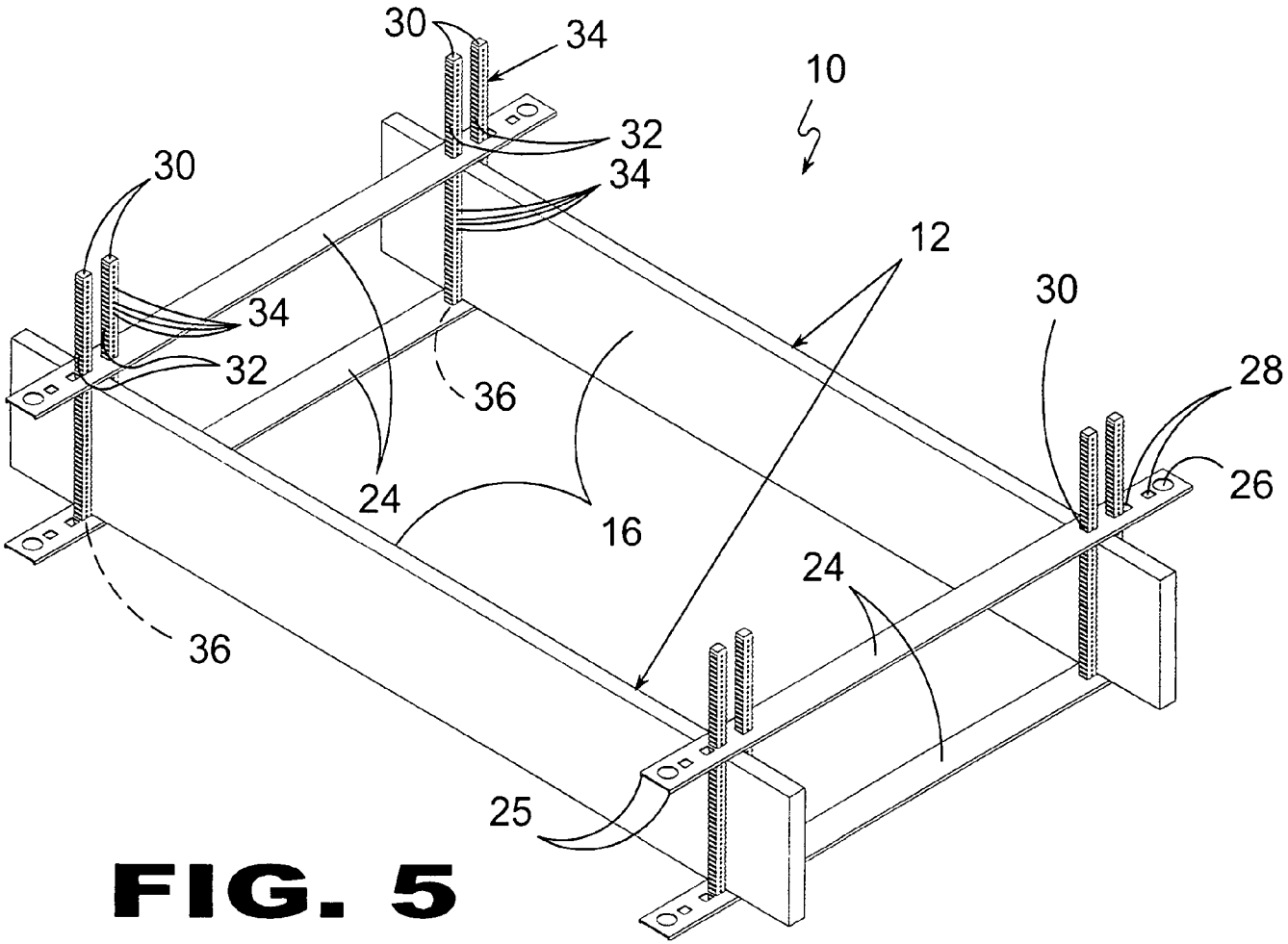
FIG. 5 is a front view of the present invention.

Turning to FIG. 5, shown is the foundation footing form of the present invention. The present invention provides form retaining walls 12 that use various materials and shapes for the form retainer walls 12, such as slab retainers 16, as illustrated. The form retainer walls 12 can be comprised of single or stacked retaining section with separator bars positioned therebetween and reinforcing posts 30 extending through the appropriate separator bar 24 aperture 28, thereby sandwiching form retaining wall 12 between a pair of reinforcing post 30. Post 30, has opposing sides with teeth or serration 32 extending out and apertures 34 passing between the adjacent sides. Preferably, aperture 28 and post serrations 32 are sized to frictionally engage one another whereby placement of a separator bar 24 aperture 28 relative to desired serrations or teeth 32 prevents casual displacement. Additionally post apertures 34 provide means whereby a length of line can be inserted therethrough and additional articles tethered to the post.

Figure 6:
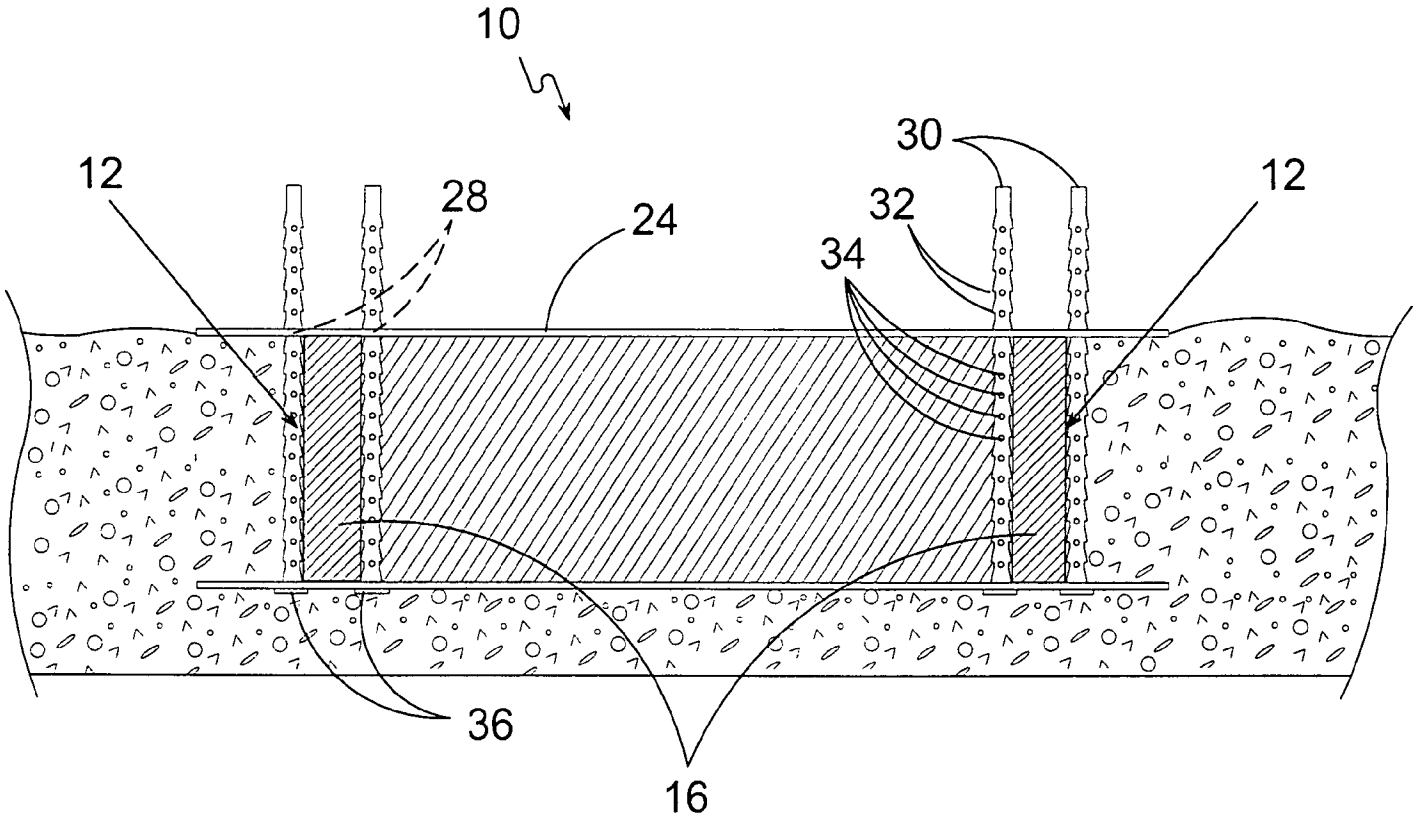
FIG. 6 is a front view of the present invention in use.

Turning to FIG. 6, shown is a sectional view of the foundation footing form of the present invention. The present invention provides form retaining walls 12 that use various materials and shapes for the form retainer walls 12, such as slab retainers 16, as illustrated. The form retainer walls 12 can be comprised of single or stacked retaining section. Depicted is a plurality of separator bars 24 and reinforcement posts 30 used to fix the form walls 12 spacing while the footing concrete is being poured. The separator bar 24 has lip 25 extending the length of both sides with a plurality of apertures 26, 28 for receiving a stake or reinforcement post 30. Apertures 28 are spaced so that retaining walls 12 are held between a pair of posts 30 with each post 30 having opposing sides with serrations or teeth 32 extending therefrom and apertures 34 passing between the adjacent sides. Preferably, aperture 28 and post serrations 32 are sized to frictionally engage one another whereby placement of a separator bar 24 aperture 28 relative to desired serrations or teeth 32 prevents casual displacement. Additionally post 30 apertures 34 provide means whereby a length of line can be inserted therethrough and additional articles tethered to the post.

Figure 7:
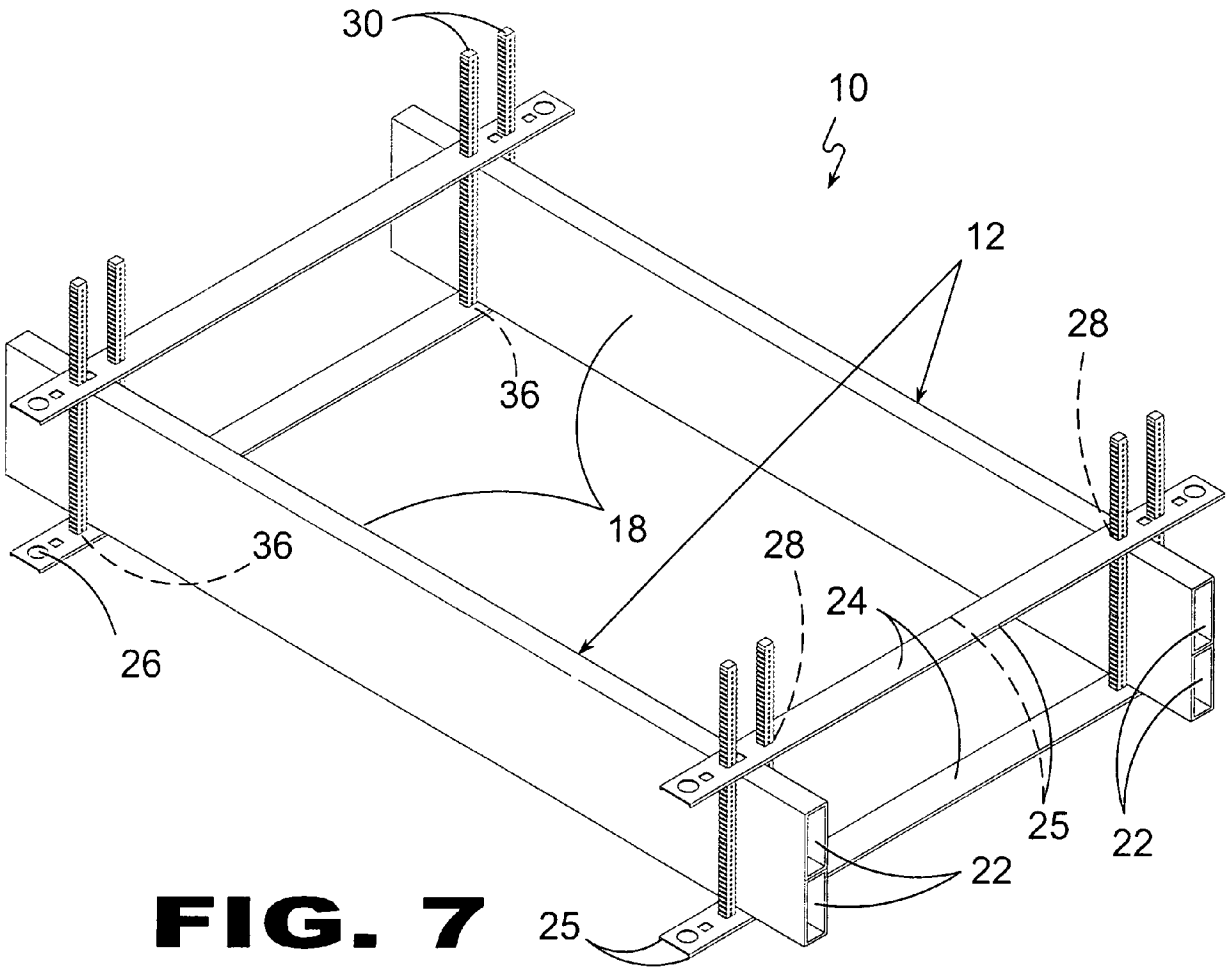
FIG. 7 is a sectional side view of the present invention in use.

Turning to FIG. 7, shown is the foundation footing form of the present invention. The present invention provides form retaining walls 12 that use various materials and shapes for the form retainer walls 12, such as conduit retainers 18, as illustrated. The form retainer walls 12 can be comprised of single or stacked retaining section. In either case, one or more separator bars 24 and reinforcement posts 30 are used to keep the form walls 12 spaced apart while the footing concrete is being poured. The separator bar 24 has lip 25 extending the length of both sides with a plurality of apertures 26, 28 for receiving a stake or reinforcement post 30, having opposing sides with serration 32 extending therefrom and apertures 34 passing between the adjacent sides. Preferably, aperture 28 and post serrations 32 are sized to frictionally engage one another whereby placement of a separator bar 24 aperture 28 relative to desired serrations or teeth 32 prevents casual displacement. Additionally post apertures 34 provide means whereby a length of line can be inserted therethrough and additional articles tethered to the post.

Figure 8:
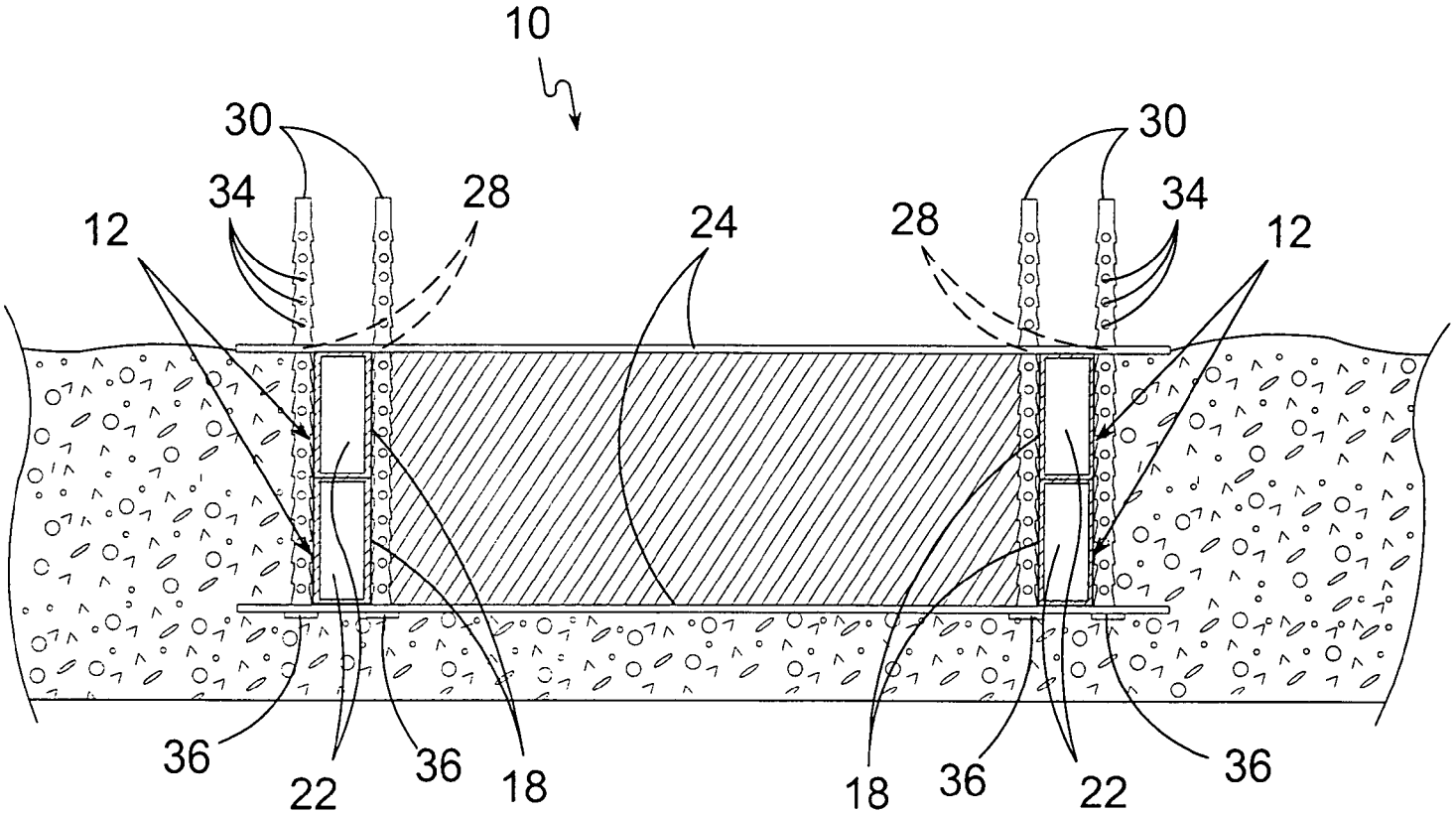
FIG. 8 is a sectional side view of the present invention in use.

Turning to FIG. 8, shown is a sectional view of the foundation footing form of the present invention. The present invention provides form retaining walls 12 that use various materials and shapes for the form retainer walls 12, such as conduit retainers 18, as illustrated. The form retainer walls 12 can be comprised of single or stacked retaining section. Depicted is a plurality of separator bars 24 and reinforcement posts 30 used to fix the form walls 12 spacing while the footing concrete is being poured. The separator bar 24 has lip 25 extending the length of both sides with a plurality of apertures 26, 28 for receiving a stake or reinforcement post 30. Apertures 28 are spaced so that retaining walls 12 are held between a pair of posts 30 with each post 30 having opposing sides with serrations or teeth 32 extending therefrom and apertures 34 passing between the adjacent sides. Preferably, aperture 28 and post serrations 32 are sized to frictionally engage one another whereby placement of a separator bar 24 aperture 28 relative to desired serrations or teeth 32 prevents casual displacement. Additionally post 30 apertures 34 provide means whereby a length of line can be inserted therethrough and additional articles tethered to the post.

Figure 9:
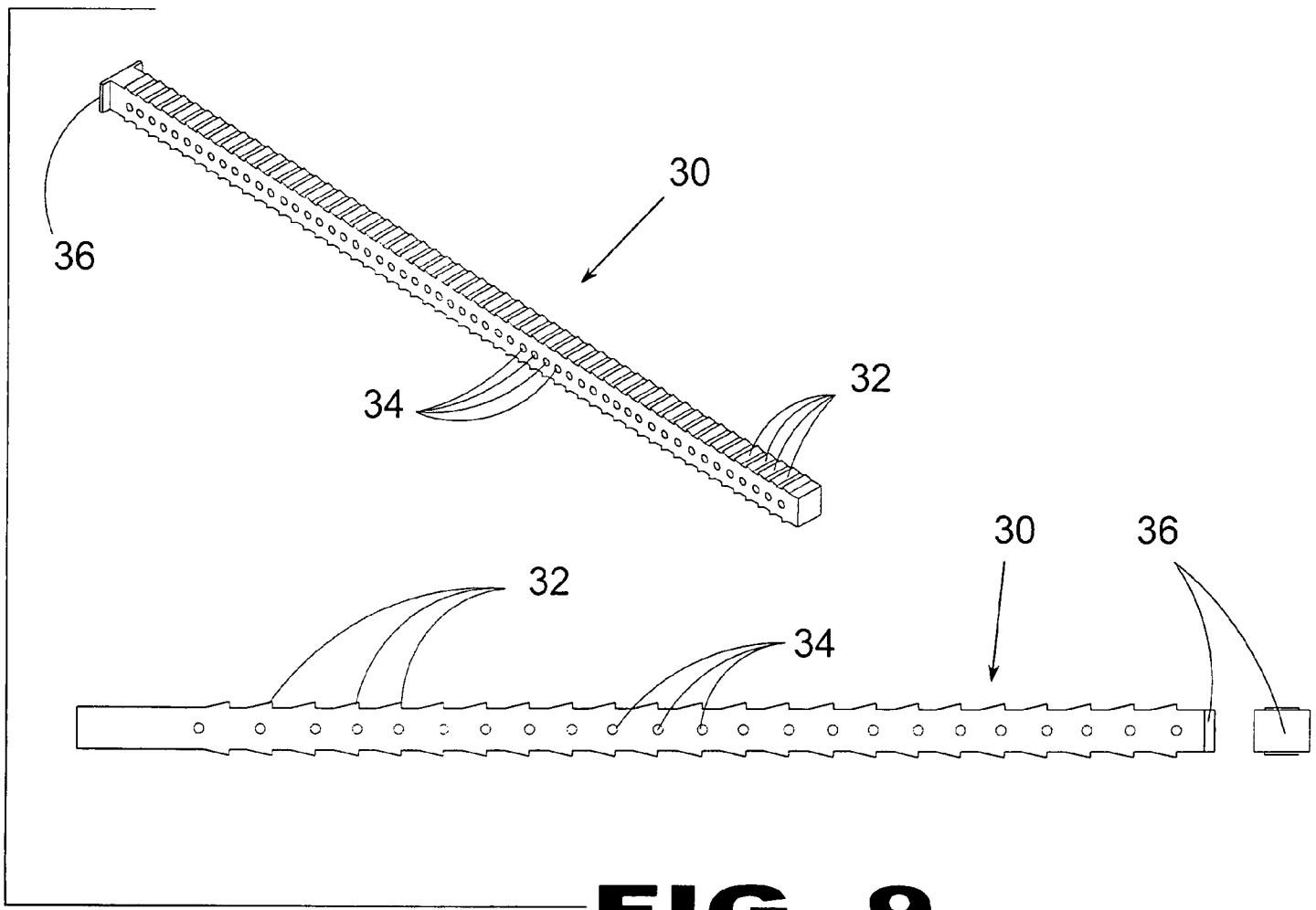
FIG. 9 is a sectional side view of the present invention in use.

Turning to FIG. 9, shown are views of the reinforcement post of the present invention. Reinforcement post 30 is used to keep the form walls 12 position fixed while the footing concrete is being poured. The reinforcement post 30, has opposing sides with teeth or serration 32 extending therefrom and apertures 34 passing between the adjacent sides. Preferably, aperture 28 of separator bar 24 and post serrations 32 are sized to frictionally engage one another whereby placement of a separator bar 24 aperture 28 relative to desired serrations or teeth 32 prevents casual displacement. Additionally post apertures 34 provide means whereby a length of line can be inserted therethrough and additional articles tethered to the post.

Figure 10:
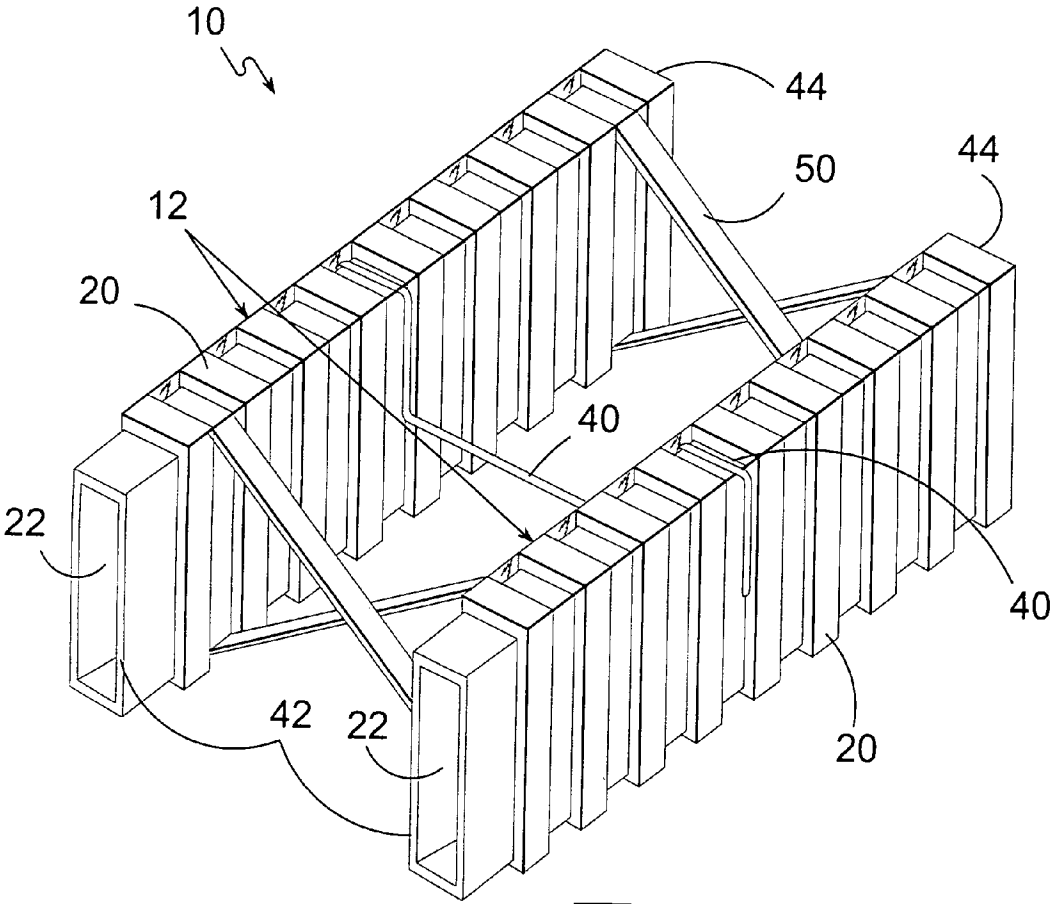
FIG. 10 is a perspective view of the present invention.

Turning to FIG. 10, shown therein is a perspective view of the present invention. Shown are the components of the present invention 10 forming a foundation footing form. A plurality of corrugated conduit retainers 20 having a male end 42 and a female end 44 are attached end to end forming spaced apart walls to receive the footing concrete thereinbetween. A plurality of straps 50 are positioned around retainer walls 12 preventing spreading of the form as the concrete is being formed. The straps 50 also form a permanent part of the footing keeping the form walls 12 in engagement with the footing during the life of the structure. A spreader 40 is used to keep the form walls 12 spaced apart while the footing is being poured. Once poured, the spreaders 40 can be removed to be used again or they can also be used as permanent members of the footing and can serve as rebar supports.

Figure 11:
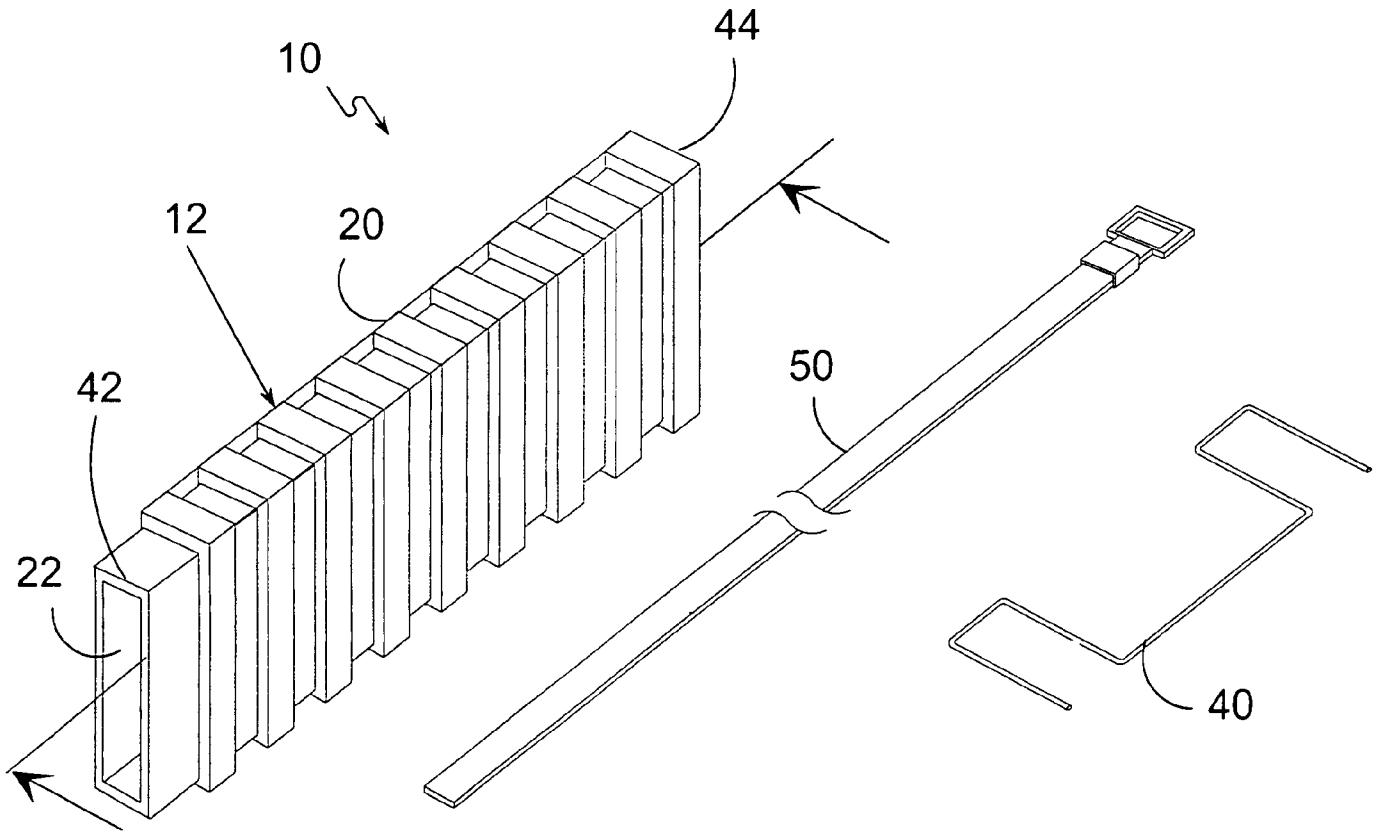
FIG. 11 is a perspective view of the components of the present invention.

Turning to FIG. 11, shown therein is a front view of the present invention. Shown are the components of the present invention 10 forming a foundation footing form. A plurality of form walls 12 are attached end to end forming spaced apart walls for the footing concrete. A plurality of straps 50 are positioned around the form walls 12 preventing spreading of the walls as the concrete is being formed. The straps 50 also form a permanent part of the footing keeping the form walls 12 in engagement with the footing during the life of the structure. A spreader 40 is used to keep the form walls 12 spaced apart while the footing is being poured. Once poured the spreaders 40 can be removed to be used again or they can also be used as permanent members of the footing and can serve as rebar supports.

Figure 12:
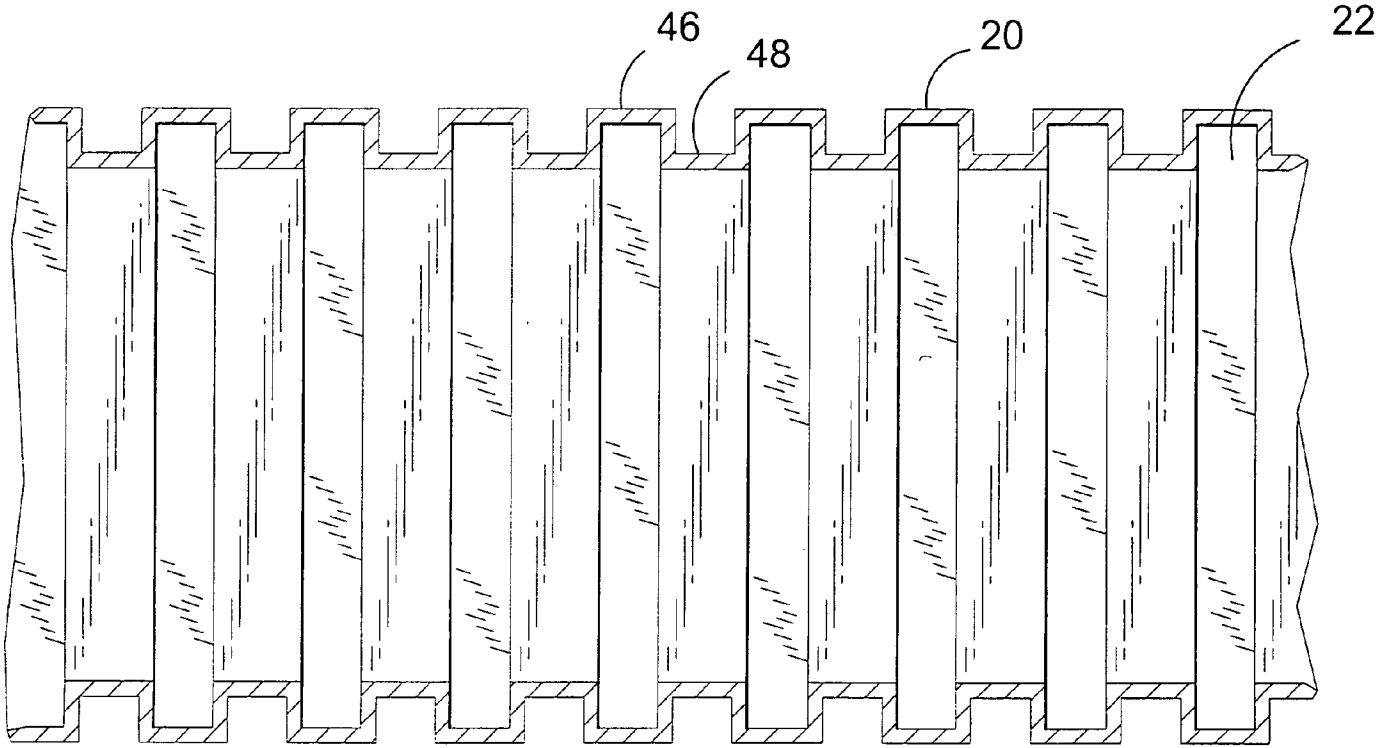
FIG. 12 is a cross sectional side of the conduit of the present invention.

Turning to FIG. 12, shown therein is a cross sectional side view of the corrugated conduit retainer 20. Shown is a cross sectional view of the retainer 20 having a corrugated-like 46, 48 structure which has considerable structural integrity affording a raceway 22 around the foundation footing that can be accessed to vent the enclosed air into the atmosphere. It should also be noted that the addition of a forced air system could be used to increase the metric volume of air into and out of the raceway.

Figure 13:
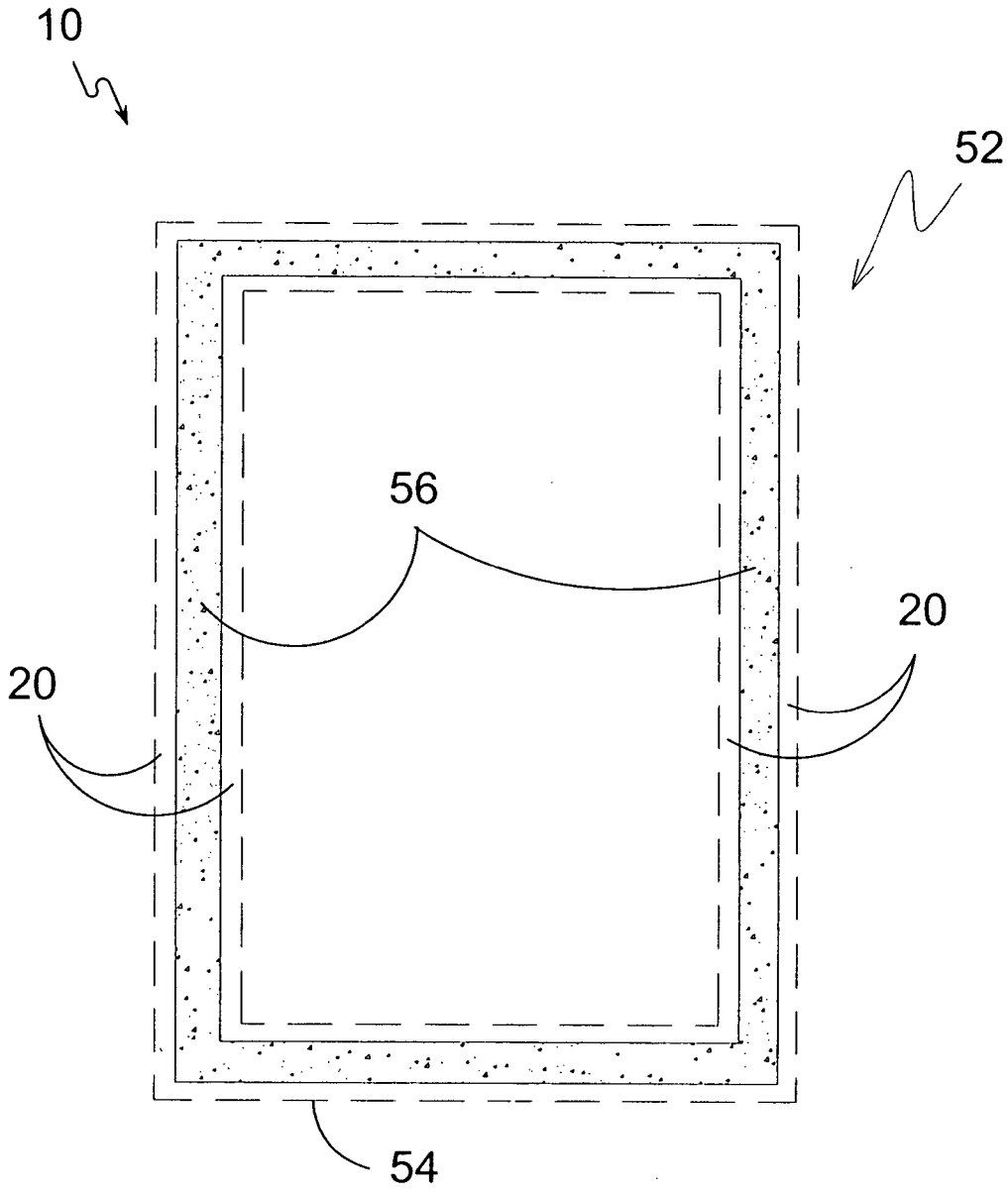
FIG. 13 is a top view of a structural foundation formed by the present invention.

Turning to FIG. 13, shown therein is a top view of a structural foundation 52 having a footing 54 forming support for the structure upon which to build the walls 56 thereof. The present invention uses spaced apart form retainer walls 12 that can be used to vent radon laden air should the structure be found after completion to have unacceptable levels of radon contained therein if the retainer walls 12 have a throughbore, such as corrugated conduit retainer 20.

Figure 14:
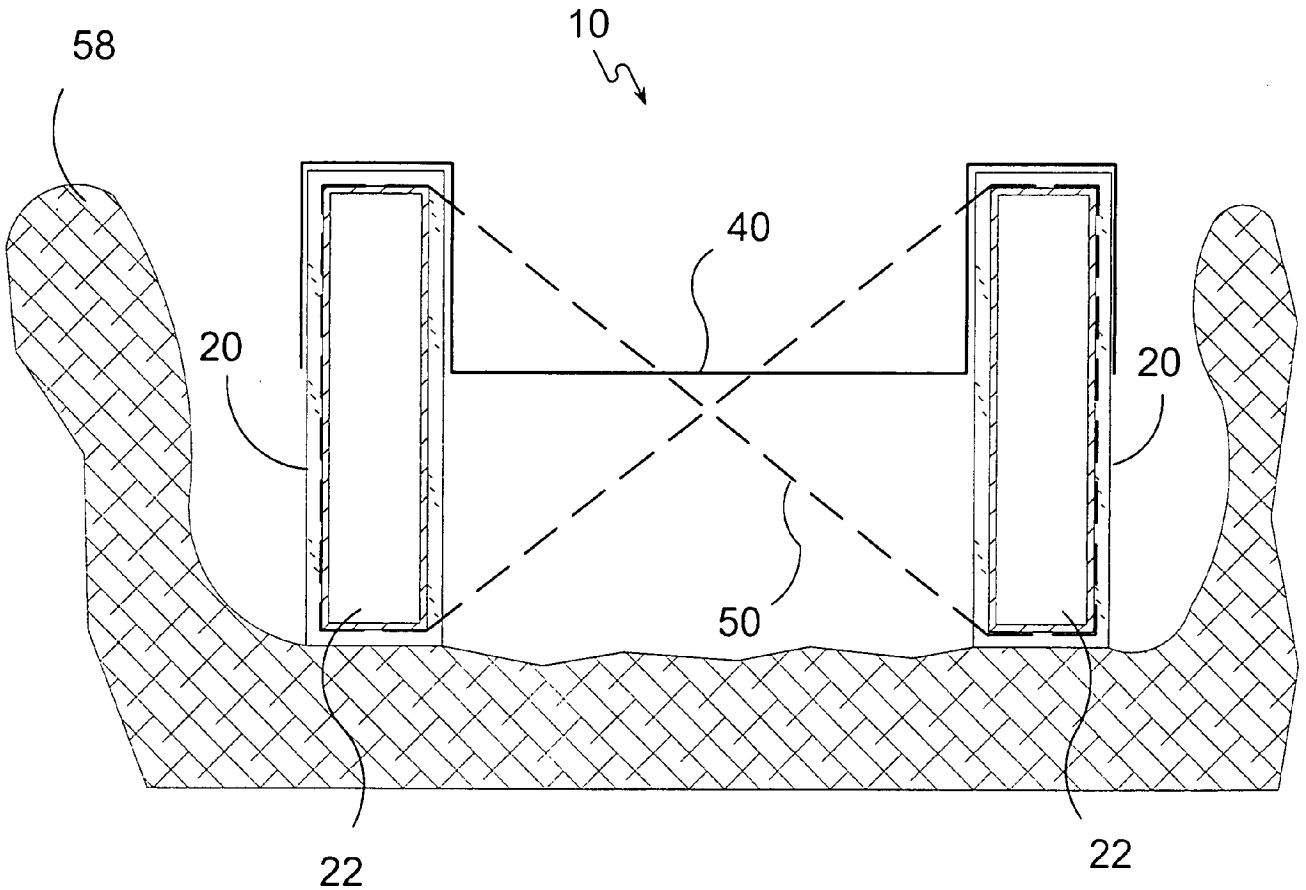
FIG. 14 is a front view of the present invention.

Turning to FIG. 14, shown therein is a front view of a foundation footing form of the present invention 10. The corrugated conduit retainers 20 are positioned spaced apart and connected end to end forming two sealed passages on each side of the foundation footing having means for keeping the walls from spreading using a strap 50. A spreader member 40 keeps the corrugated conduit retainers 20 in a spaced relation prior to the concrete being poured. The spreader 40 can be removed after the concrete has been poured having the mass of the concrete maintaining the spaced apart relation. Also shown is soil 58.

Figure 15:
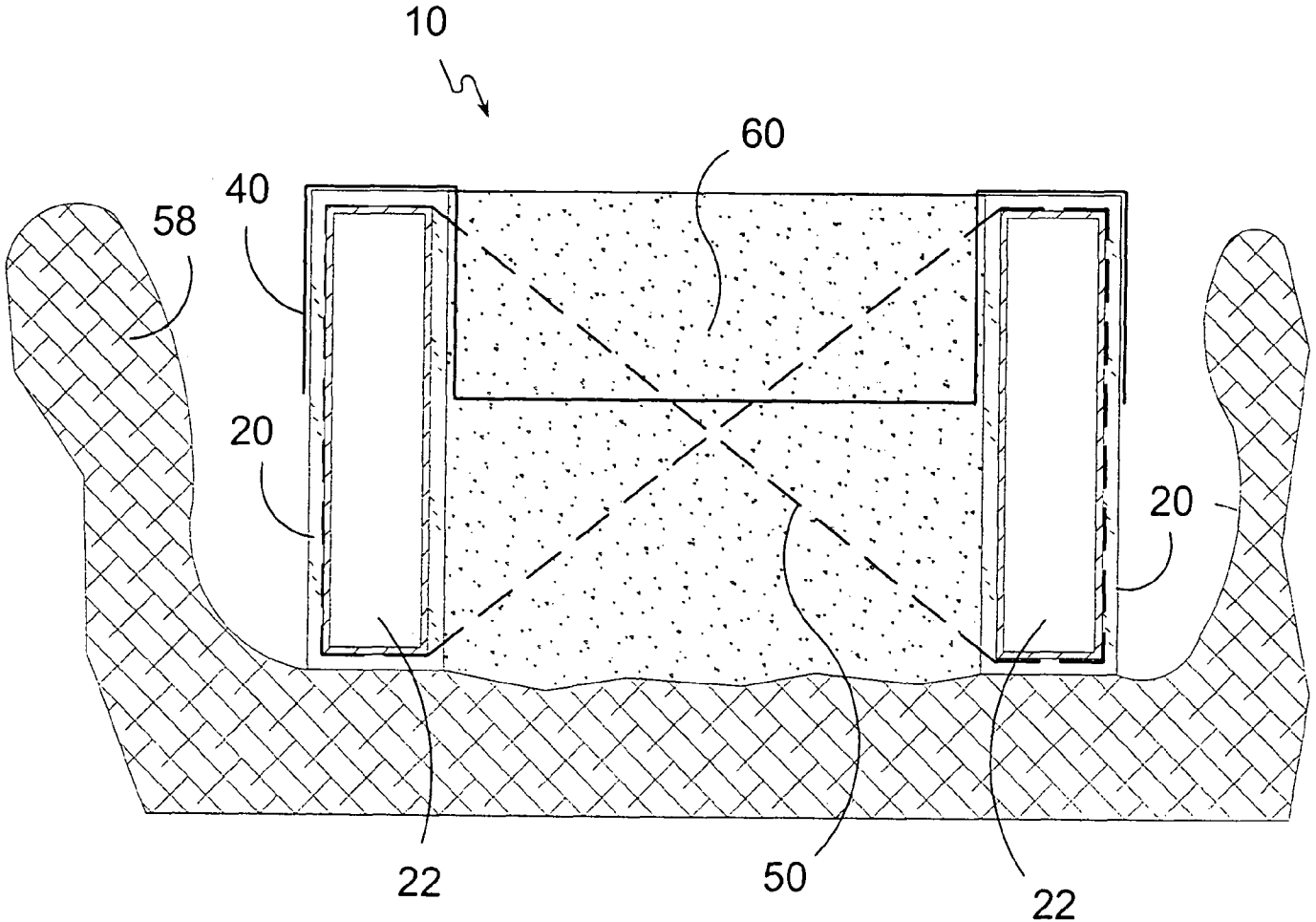
FIG. 15 is a front view of the present invention in use.

Turning to FIG. 15, shown therein is a front view of the foundation footing form of the present invention 10 having a concrete footer 60 between the corrugated conduit retainers 20. The retainers 20 are positioned spaced apart and connected end to end forming two sealed passages on each side of the foundation footing 60 having means for keeping the conduits from spreading 40 during the pouring of the concrete and means to keep the conduits in a footing engaging position 50 during the life of the footing.

Figure 16:
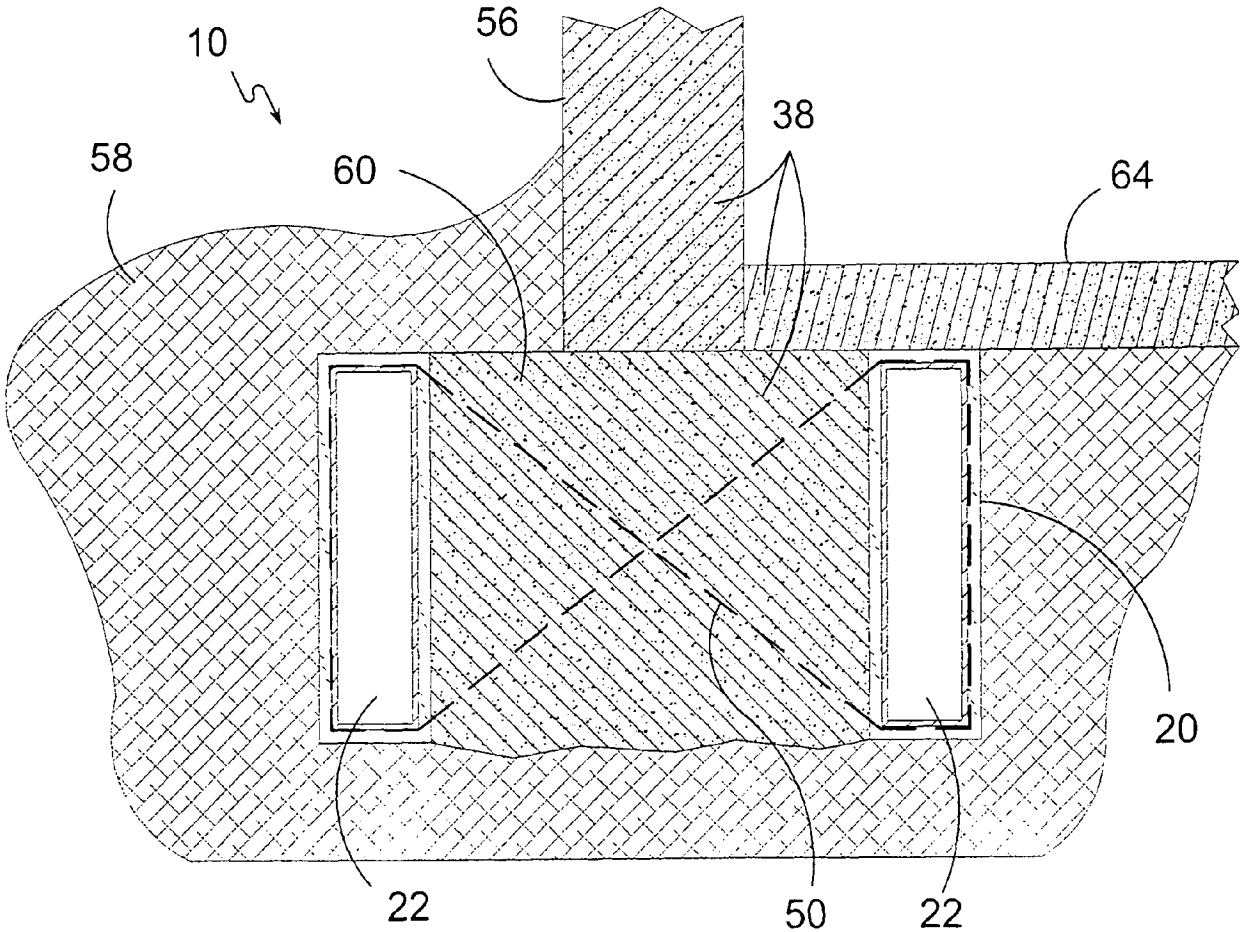
FIG. 16 is a sectional side view of the present invention in use.

Turning to FIG. 16, shown therein is a sectional view of the foundation footing form of the present invention 10 comprising spaced apart corrugated conduit retainers 20 having means for keeping the conduit from spreading using a strap 50 that is left in place as part of the footing 60. A spreader (not shown but see FIG. 17), keeps the form walls 12 in a spaced relation as concrete is being poured. The spreader 40 can be removed after the concrete has been poured whereby the mass of the concrete will maintain the spaced apart relation as the concrete cures. Once the structure is completed, radon testing may reveal unacceptable levels present. The corrugated conduit retainer 20 can be accessed by additional conduit providing means to vent the air to the exterior of the structure. Also shown are the wall 56, soil 58, and slab 64.

Figure 17:
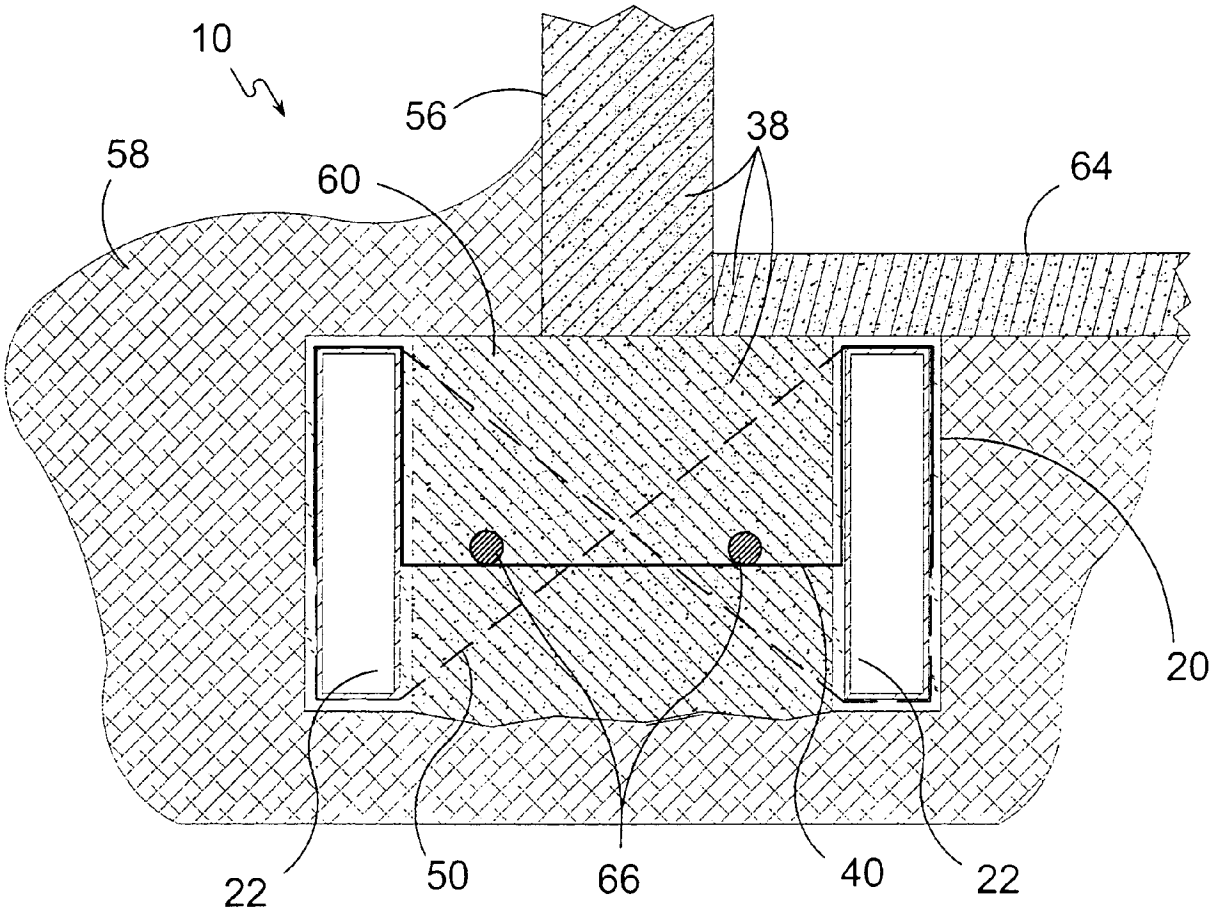
FIG. 17 is a sectional side view of the present invention in use.

Turning to FIG. 17, shown therein is a sectional view of the present invention 10 in use. Shown are the installed foundation form elements of the present invention. The form elements comprise spaced apart corrugated-like conduits 20 having a strap 50 to prevent spreading of the conduits as the concrete 62 is being poured and to keep the form walls 12 in engagement with the footing concrete after curing. Also shown is a spreader 40 to keep the corrugated retainers 20 spaced apart prior to pouring the concrete 62. The spreader 40 can be used in a permanent installation as rebar support members 66 as deemed necessary. After curing the corrugated conduit retainers 20 provide an air cavity 22 around the interior and exterior of the foundation footing 60 that can be accessed by means of other conduit either exteriorly or interiorly after a structure has been completed and unacceptable levels of radon are detected to vent the radon laden air or other unwanted gas into the atmosphere. Also shown are soil 58, wall 56, and slab 64.

Figure 18:
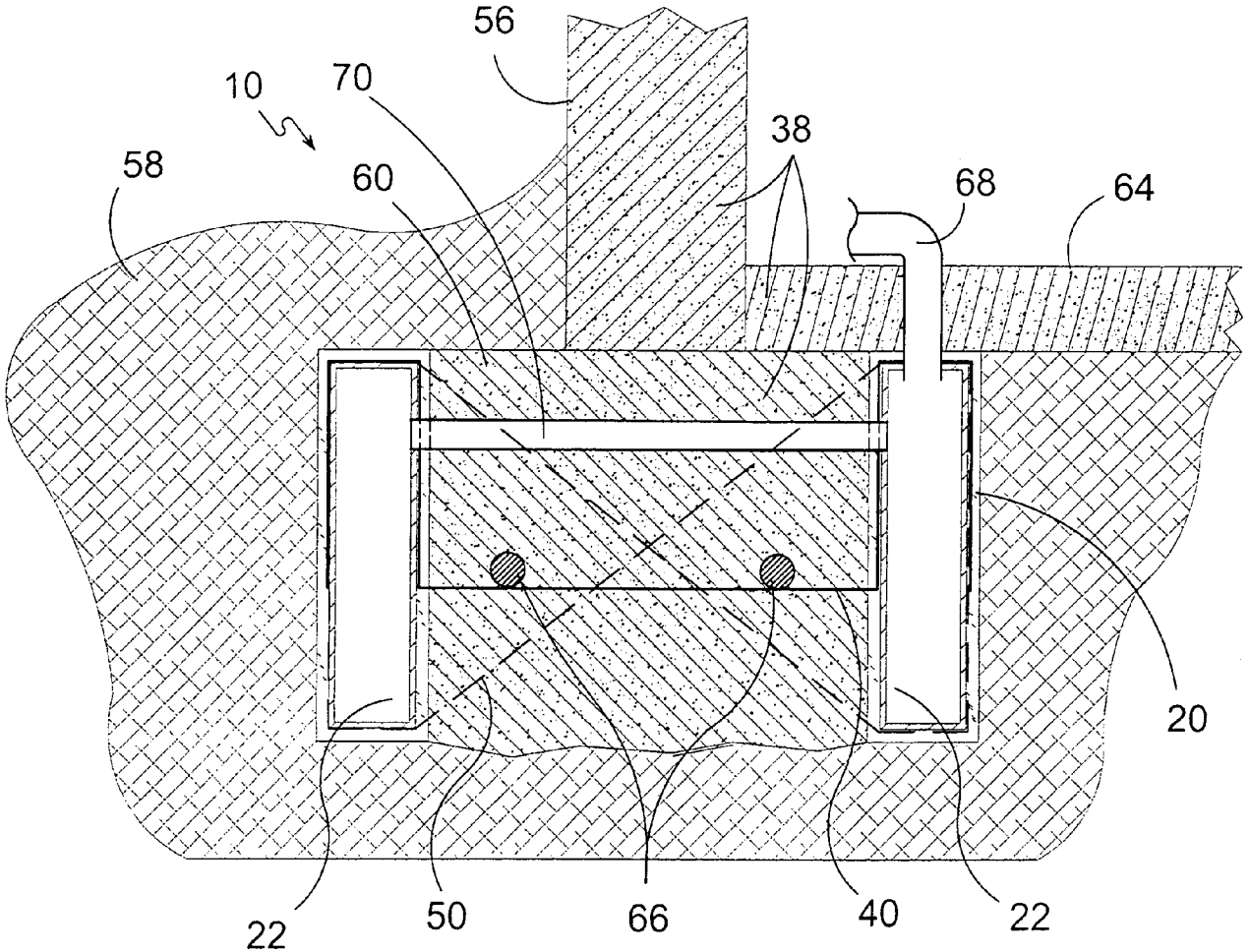
FIG. 18 is a sectional side view of the present invention in use.

Turning too FIG. 18, shown therein is a sectional view of the present invention 10 in use showing the installed foundation form elements of the present invention where unacceptable levels of radon have been detected after the structure was completed. The present invention 10 provides a means for venting radon laden air, i.e., a vent 68, from around the foundation thereby reducing the amount of radon within the structure. The venting 68 can be done from one or both of the forms. A tradesman can access the interior conduit by drilling into the slab 64 and piping the air to the exterior of the building. At least one cross-venting pipe 70 may be installed during construction communicating between the two parallel corrugated conduit retainers 20 to provide cross-venting 70 therebetween. Also shown are strap 50, rebar 66, spreader 40, soil 58, wall 56, and concrete 62.

I claim:

1. A concrete form system which provides an integral venting system for removing unwanted gases from the foundation footing of a building, said system comprising:

a pair of conduit retainers for forming the footing of the building, said pair of conduit retainers being spaced apart to receive concrete there between, said concrete forming the footing of the foundation of the building, each of said conduit retainers being formed of a plurality of conduit sections, each conduit having opposed male and female ends joining adjacent conduit sections, each conduit section having a corrugated tubular wall with inner and outer surfaces, said outer surface of said corrugated tubular wall defining a periphery thereof, said inner surface defining a hollow cavity therein, said corrugated tubular wall having a plurality of recessed sections positioned between raised sections;

at least one spreader bar rigidly connecting said pair of conduit retainers and holding apart said pair of conduit retainers when concrete is placed there between, each of said at least one spreader bar having a linear center section and two opposed u-shaped end sections, each of said u-shaped end sections receiving the recessed section of a respective one of said pair of conduit retainers, the center section of each of said at least one spreader bar being positioned below a top surface of its respective recessed sections;

at least one strap extending around said pair of conduit retainers holding said pair of conduit retainers in position when concrete is placed there between; and at least one air vent disposed in a top surface of each of said pair of conduit retainers to permit air to be vented from each hollow cavity to the atmosphere.

2. The concrete form system of claim 1, further comprising system at least one cross-vent extending between said pair of conduit retainers and in communication with the hollow cavity of each conduit retainer allowing air to be drawn between said pair of conduit retainers.

3. The concrete form system of claim 2, wherein each of said at least one cross-vent has opposed ends, each end being connected to an inner sidewall of its respective conduit retainer above a midline thereof.

4. The concrete form system of claim 2, wherein each of said at least one cross-vent is connected to an inner sidewall of each of said pair of conduit retainers closer to the top surface than a bottom surface.

5. The concrete form system of claim 2, wherein said at least one strap comprises a flexible material.

6. The concrete form system of claim 2, wherein said at least one spreader bar comprises a metal rod.

* * * * *